US006214510B1

(12) United States Patent
Kojima et al.

(10) Patent No.: US 6,214,510 B1
(45) Date of Patent: Apr. 10, 2001

(54) EXTERNAL ADDITION TONER, APPARATUS FOR FORMING IMAGE, AND PROCESS FOR FORMING IMAGE

(75) Inventors: Noriaki Kojima; Hiroyuki Koide; Kazuhisa Masuko; Takatoshi Ishikawa, all of Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/645,353

(22) Filed: Aug. 25, 2000

(30) Foreign Application Priority Data

Sep. 14, 1999 (JP) ..... 11-260954

(51) Int. Cl.[7] ..... G03G 9/097; G03G 15/08
(52) U.S. Cl. ..... 430/110; 430/111; 399/252
(58) Field of Search ..... 430/110, 111; 399/252

(56) References Cited

U.S. PATENT DOCUMENTS

| | | | | |
|---|---|---|---|---|
| 5,296,324 | * | 3/1994 | Akagi et al. | 430/111 |
| 5,305,061 | * | 4/1994 | Takama et al. | 430/111 |
| 5,747,211 | * | 5/1998 | Hagi et al. | 430/110 |
| 5,809,378 | * | 9/1998 | Kukimoto et al. | 430/111 |
| 5,827,632 | * | 10/1998 | Inaba et al. | 430/111 |
| 5,948,582 | * | 9/1999 | Nakamura et al. | 430/110 |
| 5,981,132 | * | 11/1999 | Kurose et al. | 430/110 |
| 6,103,441 | * | 8/2000 | Tomita et al. | 430/110 |

FOREIGN PATENT DOCUMENTS

| | | |
|---|---|---|
| 5-34979 | 2/1993 | (JP) . |
| 5-88409 | 4/1993 | (JP) . |
| 5-197193 | 8/1993 | (JP) . |
| 5-341573 | 12/1993 | (JP) . |

* cited by examiner

*Primary Examiner*—Roland Martin
(74) *Attorney, Agent, or Firm*—Oliff & Berridge, PLC

(57) ABSTRACT

An external addition toner that sufficiently exhibits the effect of an external additive and is excellent in transfer property, and an apparatus for forming an image and a process for forming an image excellent in general purpose property that provide an image of good quality without formation of image defects, such as transfer unevenness and drop off due to transfer failure of the toner. An external addition toner is employed, in which the shape coefficient of the toner particles, as well as a coating ratio x (%) of the external additive to a surface area of the toner particles, a volume average particle diameter D (μm) of the toner particles and a volume average particle diameter d (μm) of the external additive having the maximum average particle diameter satisfy the prescribed relationship. Furthermore, a developer is employed, which contains a toner charged to a charge amount q (μC/g) satisfying the following equation corresponding to the volume average particle diameter D (μm) of the toner particles:

$$q \geqq 929.5/D^2$$

20 Claims, 11 Drawing Sheets

EXTERNAL ADDITION TONER, APPARATUS FOR FORMING IMAGE, AND PROCESS FOR FORMING IMAGE

FIELD OF THE INVENTION

The present invention relates to an external addition toner, an apparatus for forming an image, and a process for forming an image.

BACKGROUND OF THE INVENTION

In the electrophotographic process, an electrostatic latent image formed on a photoreceptor is developed with a developer containing a toner, and a toner image obtained is transferred to a recording medium such as paper, followed by fixing with a heat roll, so as to obtain an image on the recording medium. A full color image can be obtained by overlapping toner images of four colors, i.e., cyan, yellow, magenta and black, utilizing the electrophotographic process.

In recent years, an image forming apparatus of an intermediate transfer type has been subjected to practical use, in which toner images of cyan, yellow, magenta and black formed on a photoreceptor are primarily transferred on an intermediate transfer material, and a multi-color image formed on the intermediate transfer material is secondarily transferred to a recording media, and thus speeding up of a color duplicator using the electrophotographic process is realized. In the image forming apparatus of an intermediate transfer type, however, because the number of times of transfer is large, and the multi-color toner image is transferred to a recording medium at a time, it is liable to cause a problem of image defects, such as transfer unevenness and drop-off. Furthermore, it is liable to cause another problem of lack of general purpose property in that even though a good image can be formed on a recording medium having a smooth surface, such as coated paper, image defects occur when an image is formed on a recording medium having a rough surface, such as recycled paper.

JP-A-5-34979, JP-A-5-88409, JP-A-5-197193 and JP-A-5-341573 disclose that the transfer property of the toner is improved by providing fine holes or protrusions on the surface of toner particles having a substantially spherical shape.

In the toner using the toner particles having fine holes and protrusions on the surface thereof, however, there is a problem in that the effect of an external additive coated on the toner particles cannot be sufficiently exhibited.

The external additive fundamentally exhibits such a function in that it intervenes between an image holding member and the toner particles to prevent the toner particles from adhering on the image holding member, whereby the transfer property of the toner is improved. However, in the case where unevenness is present on the surface of the toner particles, when the toner is stirred and subjected to mechanical stress in a developing device, the external additive fails at the protruded surface of the toner particles, whereas the external additive is accumulated at the reentrant surface. Thus, the toner particles are in contact with the image holding member without the external additive intervening at the protruded surface, so as to prevent the external additive from exhibiting the function thereof, whereby image defects, such as transfer unevenness and drop off, occur.

With the progress of decrease in particles size of the toner for realizing a high quality image, it is becoming difficult to completely transfer the toner particles without remaining on the image holding member. The conventional apparatus for forming an image is designed without sufficiently considering the difference in transfer property depending on the size of the toner particles.

SUMMARY OF THE INVENTION

Therefore, the invention has been made to provide an external addition toner excellent in transfer property. The invention has also been made to provide an apparatus for forming an image and a process for forming an image excellent in general purpose property that can provide an image of high quality without forming image defects, such as transfer unevenness and drop off, due to transfer failure of the toner, irrespective to the type of the recording medium.

The invention relates to an external addition toner containing toner particles having a shape coefficient of 134 or less coated with an external additive, the external additive containing fine particles having a volume average particle diameter (d) of from 0.05 to 0.5 $\mu$m, a coating ratio x of the external additive to a surface area of the toner particles being in a range of from 15 to 100%, and the coating ratio x (%), a volume average particle diameter of the toner particles D ($\mu$m) and a volume average particle diameter of the external additive having the maximum average particle diameter d ($\mu$m) satisfying the following equation (1):

$$100 \le \frac{(D+2d)^2}{\pi\left(\frac{D}{2}\right)^2 + n\pi\left(\frac{d}{2}\right)^2} \cdot \frac{\pi}{4} \cdot 100 \le 165 \tag{1}$$

wherein $$n = \frac{\pi D \frac{x}{100}}{d}$$

The invention also relates to an external addition toner containing toner particles having a surface property index of 5.1 or less coated with an external additive, the external additive containing fine particles having a volume average particle diameter (d) of from 0.05 to 0.5 $\mu$m, a coating ratio x of the external additive to a surface area of the toner particles being in a range of from 15 to 100%, and the coating ratio x (%), a volume average particle diameter of the toner particles D ($\mu$m) and a volume average particle diameter of the external additive d ($\mu$m) satisfying the following equation (2):

$$1.005 \le \frac{4\pi\left(\frac{D}{2}\right)^2 + n \cdot 4\pi\left(\frac{d}{2}\right)^2}{4 \cdot \pi\left(\frac{D}{2}\right)^2} \le 1.524 \tag{2}$$

wherein $$n = \frac{\pi \cdot D \cdot \frac{x}{100}}{d}$$

In a preferred embodiment of the invention, the external addition toner contains toner particles having a shape coefficient of 134 or less and a surface property index of 5.1 or less coated with an external additive having a volume average particle diameter (d) of from 0.05 to 0.5 $\mu$m, a coating ratio x of the external additive to a surface area of the toner particles being in a range of from 15 to 100%, and the coating ratio x (%), a volume average particle diameter of the toner particles D (μm) and a volume average particle diameter of the external additive d (μm) satisfying the equations (1) and (2).

The invention also relates to an apparatus for forming an image containing a developing device charged with a developer containing a toner that is charged to a charge amount q (μC/g) corresponding to a volume average particle diameter D (μm) of the toner particles satisfying the following equation (3), an image holding member retaining a developed image formed by the developer containing a toner charged to a charge amount q (μC/g), and a transfer device transferring the developed image on the image holding member to a transfer medium:

$$q \geqq 929.5/D^2 \quad (3)$$

While a one-component developer containing the external addition toner of the invention may be used as the developer for the apparatus for forming an image, it is preferred to use a two-component developer containing the external addition toner of the invention and a carrier. The apparatus for forming an image can be used for forming a multi-color image, in which a multi-color developed image formed by accumulating plural toner images of plural colors on the image holding member.

The apparatus for forming an image of the invention may contain a photoreceptor forming an electrostatic latent image corresponding to image information, a developing device for developing the electrostatic latent image with a developer containing a toner that is charged to a charge amount q (μC/g) corresponding to a volume average particle diameter D (μm) of the toner particles satisfying the following equation (3), an intermediate transfer material, in which a developed image formed by the developer containing a toner charged to a charge amount q (μC/g) is transferred thereon, and the transferred image is temporarily retained, and a transfer device transferring the image on the intermediate transfer material to a recording medium by pressing the intermediate transfer material with a transfer member.

While a one-component developer containing the external addition toner of the invention may be used as the developer for the apparatus for forming an image, it is preferred to use a two-component developer containing the external addition toner of the invention and a carrier. The apparatus for forming an image can be used for forming a multi-color image, in which a multi-color developed image formed by accumulating plural toner images of plural colors on the intermediate transfer material. It is preferred that the intermediate transfer material has a surface having a contact angle with water of 75° or more. It is also preferred that the pressure between the intermediate transfer material and the transfer member is 10 gf/mm or more.

The invention also relates to a process for forming an image containing a developing step of developing an electrostatic latent image formed on an image holding member with a developer containing a toner that is charged to a charge amount q (μC/g) corresponding to a volume average particle diameter D (μm) of the toner particles satisfying the following equation (3), and a transferring step of transferring an image on the image holding member developed with the developer containing the toner charged to a charge amount q (μC/g).

While a one-component developer containing the external addition toner of the invention may be used as the developer for the process for forming an image, it is preferred to use a two-component developer containing the external addition toner of the invention and a carrier.

The process for forming an image of the invention may contain a developing step of developing an electrostatic latent image formed on an image holding member with a developer containing a toner that is charged to a charge amount q (μC/g) corresponding to a volume average particle diameter D (μm) of the toner particles satisfying the following equation (3), a primary transferring step of transferring an image developed with the developer containing the toner charged to a charge amount q (μC/g) to an intermediate transfer material to temporarily retain the image, and a secondary transferring step of transferring the image on the intermediate transfer material to a recording medium by pressing with a transfer member.

While a one-component developer containing the external addition toner of the invention may be used as the developer for the process for forming an image, it is preferred to use a two-component developer containing the external addition toner of the invention and a carrier. It is also preferred that the pressure between the intermediate transfer material and the transfer member is 10 gf/mm or more.

In the invention, toner particles coated with an external additive are called as an external addition toner or a toner, and toner particles before being coated with an external additive are simply called as toner particles.

BRIEF DESCRIPTION OF THE DRAWINGS

Preferred embodiments of the present invention will be described in detail based on the following figures, wherein.

DETAILED DESCRIPTION OF THE INVENTION

Figure 1:
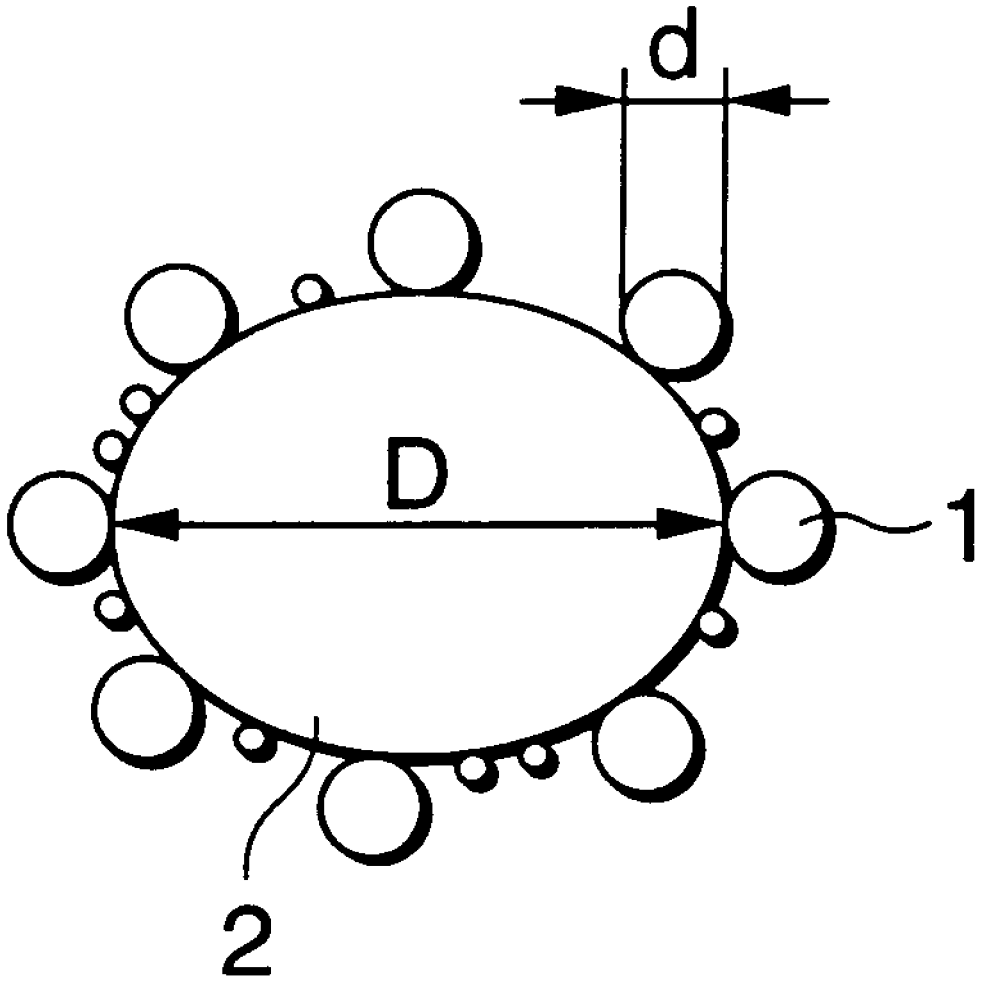
FIG. 1 is a schematic diagram showing the state of the external addition toner of the invention.

The external addition toner of the invention contains at least an external additive and toner particles. In the invention, the state of the external additive coated on the toner particles, and the state of the external addition toner coated with the external additive is defined by the shape coefficient as follows.

The external addition toner of the invention is obtained by coating an external additive on toner particles having a shape coefficient of 134 or less, the external additive coated has a volume average particle diameter of from 0.05 to 0.5 μm, the coating ratio x of the external additive is in a range of from 15 to 100%, and the coating ratio x (%), the volume average particles diameter of the toner particles D (μm) and the volume average particle diameter of the external additive d (μm) satisfy the following equation (1):

$$100 \leq \frac{(D+2d)^2}{\pi\left(\frac{D}{2}\right)^2 + n\pi\left(\frac{d}{2}\right)^2} \cdot \frac{\pi}{4} \cdot 100 \leq 165 \quad (1)$$

wherein $$n = \frac{\pi D \frac{x}{100}}{d}$$

In the external addition toner of the invention, toner particles have a shape coefficient of 134 or less. When the shape coefficient exceeds 134, the transfer property of the toner is decreased, and in particular, transfer unevenness becomes remarkable on a transfer medium having small surface smoothness, such as recycled paper. The shape coefficient of the toner particles is preferably 125 or less.

The shape coefficient is a value obtained by dividing $\pi L^2/4$, wherein L is the maximum diameter of the toner particles, and A is the actual projected area of the toner particles, which corresponds to the projected area of a true sphere having a diameter L, by A, and expressed in terms of percent. The shape coefficient is represented by $100\pi L^2/4A$, and when the value approaches 100, the toner particles approach a true sphere, whereas when the value exceeds to leave 100, the toner particles become a so-called irregular shape. For example, the conventional irregular toner particles produced by the kneading and pulverization method have a shape coefficient of 140 or more.

The value of the shape coefficient can be obtained by observing the toner particles with an optical microscope (Nikon Microphot-FXA, produced by Nikon Corp.), and the enlarged image obtained is imported into an image analyzer (LUZEX III, produced by Nireco Corp.). The shape coefficient is calculated as an average value of plural toner particles.

In the external addition toner of the invention, the maximum average particle diameter of the external additive coated on the toner particles is from 0.05 to 0.5 μm, the coating ratio x of the external additive to a surface area of the toner particles is in a range of from 15 to 100%, and the coating ratio x (%), a volume average particle diameter of the toner particles D (μm) and a volume average particle diameter of the external additive d (μm) satisfy the following equation (1):

$$100 \leq \frac{(D+2d)^2}{\pi\left(\frac{D}{2}\right)^2 + n\pi\left(\frac{d}{2}\right)^2} \cdot \frac{\pi}{4} \cdot 100 \leq 165 \quad (1)$$

wherein $$n = \frac{\pi D \frac{x}{100}}{d}$$

For convenience, when only the external additive having the maximum average particle diameter is considered among the external additives coated on the toner particles, the external additive 1 covers the surface of the toner particles 2 as forming protrusions on the surface of the toner particles 2, as shown in FIG. 1. The physical value corresponding to the shape coefficient is obtained for the toner coated with the external additive (hereinafter referred to as a shape coefficient after coating).

The maximum diameter of the toner after coated with the external additive is (D+2d). The actual projected area B of the toner after coated with the external additive is a value obtained by adding the projected area of the toner particles $\pi(D/2)^2$ and the projected area of the external additive having the maximum average particle diameter. When the number of external additive having the maximum average particle diameter coated on the surface of the toner particles is n, the projected area of the external additive having the maximum average particle diameter is $n\pi(d/2)^2$, and thus the projected area B is $\pi(D/2)^2+n\pi(d/2)^2$. When the projected area $\pi(D+2d)^2/4$ of a true sphere having a diameter (D+2d) is divided by B and expressed in terms of percent, the shape coefficient after coating can be obtained by the following equation:

$$\frac{(D+2d)^2}{\pi\left(\frac{D}{2}\right)^2 + n\pi\left(\frac{d}{2}\right)^2} \cdot \frac{\pi}{4} \cdot 100$$

wherein $$n = \frac{\pi D \frac{x}{100}}{d}$$

In the external addition toner of the invention, the lower limit of the shape coefficient after coating is 100, and the shape coefficient is preferably 101 or more, and more preferably 104 or more. The upper limit thereof is 165, and it is preferably 135 or less, and more preferably 111 or less. When the shape coefficient after coating is less than 100, release of the external additive from the toner particles easily occurs to cause image defects. When it exceeds 165, the external additive is difficult to exhibit the function as the transfer aid, and transfer failure is liable to occur.

The coating ratio x is in the range of from 15 to 100%, preferably from 20 to 100%, and more preferably from 20 to 60%. When the coating ratio x is less than 15%, the effect of addition of the external additive cannot be sufficiently obtained. The volume average particle diameter D (μm) of the toner particles is preferably from 3 to 8 μm, and more preferably from 5 to 6 μm. The volume average particle diameter d (μm) of the external additive having the maximum average particle diameter is from 0.05 to 0.5 μm, and preferably from 0.1 to 0.5 μm, and more preferably from 0.1 to 0.2 μm.

The state of the external additive toner containing the toner particles coated with the external additive can also be expressed by using the surface property index as follows.

The external addition toner of the invention contains toner particles having a surface property index of 5.1 or less coated with an external additive having a volume average particle diameter (d) of from 0.05 to 0.5 μm, a coating ratio x of the external additive having the maximum average particle diameter to a surface area of the toner particles is in a range of from 15 to 100%, and the coating ratio x (%), a volume average particle diameter of the toner particles D (μm) and a volume average particle diameter of the external additive d (μm) satisfy the following equation (2):

$$1.005 \leq \frac{4\pi\left(\frac{D}{2}\right)^2 + n \cdot 4\pi\left(\frac{d}{2}\right)^2}{4 \cdot \pi\left(\frac{D}{2}\right)^2} \leq 1.524 \quad (2)$$

wherein $$n = \frac{\pi \cdot D \cdot \frac{x}{100}}{d}$$

In the external addition toner of the invention, the toner particles having a surface property index of 5.1 or less are used. When the surface property index exceeds 5.1, the transfer property of the toner is decreased, and in particular, image defects, such as drop off, become remarkable. The surface property index of the toner particles is 5.1 or less, and preferably 2.0 or less.

The surface property index is a value showing the extent of unevenness on the surface of particles, and is a value T/C obtained by dividing the actual specific surface area T by nitrogen adsorption actually measured by the BET method by the specific surface area C calculated by the following equation with consideration of the particle diameter distribution measured by a Coulter counter (produced by Coulter Corp.). The larger the surface property index is, the larger the extent of unevenness on the surface of the particles is.

$$C = \frac{6\sum(n \times R^2)}{\rho\sum(n \times R^3)}$$

In the equation, n is the number of particles in one channel of the Coulter counter, R is the average particle diameter in one channel of the Coulter counter, and ρ is the density of the toner particles.

In the external addition toner of the invention, the coating ratio x of the external additive having a volume average particle diameter (d) of from 0.05 to 0.5 μm to a surface area of the toner particles is in a range of from 15 to 100%, and the coating ratio x (%), a volume average particle diameter of the toner particles D (μm) and a volume average particle diameter of the external additive d (μm) satisfy the equation (2).

The physical value corresponding to the surface property index is obtained for the toner coated with the external additive (hereinafter referred to as a surface property index after coating).

In the toner after coating with the external additive, the actual surface area T can be approximated by the value obtained by adding the surface area of the toner particles $4\pi(D/2)^2$ and the total surface area of the external additive having the maximum average particle diameter coated on the toner particles $n4\pi(d/2)^2$. On the other hand, the surface area C can be approximated by $4\pi(D/2)^2$ from the volume average particle diameter of the toner particles, and thus the surface property index after coating T/C can be obtained from the following equation:

$$\text{Surface property index after coating} = \frac{4\pi\left(\frac{D}{2}\right)^2 + n \cdot 4\pi\left(\frac{d}{2}\right)^2}{4 \cdot \pi\left(\frac{D}{2}\right)^2}$$

wherein $$n = \frac{\pi \cdot D \cdot \frac{x}{100}}{d}$$

In the external addition toner of the invention, the lower limit of the surface property index after coating is 1.005, and the surface property index after coating is preferably 1.010 or more. The upper limit thereof is 1.524, and it is preferably 1.314 or less, and more preferably 1.075 or less. When the surface property index after coating is less than 1.005, release of the external additive from the toner particles occurs to cause image defects, and when the surface property index after coating exceeds 1.524, the external additive is difficult to exhibit the effect as a transfer aid, and transfer failure is liable to occur.

The coating ratio x is in the range of from 15 to 100%, preferably from 20 to 100%, and more preferably from 20 to 60%. When the coating ratio is less than 15%, the effect of addition of the external additive cannot be sufficiently obtained. The volume average particle diameter D (μm) of the toner particles is preferably from 3 to 8 μm, and more preferably from 5 to 6 μm. The volume average particle diameter d (μm) of the external additive having the maximum average particle diameter is from 0.05 to 0.5 μm, and preferably from 0.1 to 0.5 μm, and more preferably from 0.1 to 0.2 μm.

From the standpoint of improvement in transfer property, the external addition toner preferably contains toner particles having a shape coefficient of 134 or less and a surface property index of 5.1 or less coated with an external additive, a coating ratio x of the external additive having a volume average particle diameter (d) of from 0.05 to 0.5 μm to a surface area of the toner particles being in a range of from 15 to 100%, and the coating ratio x (%), a volume average particle diameter of the toner particles D (μm) and a volume average particle diameter of the external additive d (μm) satisfying the equations (1) and (2).

The toner particles used in the external addition toner of the invention can be produced by the process described in JP-A-10-26842. The production process contains a first step of forming coagulated particles in a dispersion having at least resin particles dispersed therein to prepare a coagulated particle dispersion by, a second step of forming adhered particles by adding and mixing a fine particle dispersion having fine particles dispersed therein to the coagulated particle dispersion to adhere the fine particles to the coagulated particles, and a third step of fusing the adhered particles by heating, and toner particles having a desired shape coefficient or a desired surface property index can be produced by adjusting the extent of heating and fusing in the third step.

The process for producing the toner particles will be described in detail below.

(First Step)

In the first step, coagulated particles are formed in a dispersion to prepare a coagulated particle dispersion. (Hereinafter, the first step is sometimes called as a coagulation step.)

The dispersion is formed by dispersing at least resin particles.

The resin particles are particles formed with a resin.

Examples of the resin include a thermoplastic binder resin, and specific examples thereof include a homopolymer or a copolymer of a styrene compound, such as styrene, p-chlorostyrene and α-methylstyrene (a styrene series resin); a homopolymer or a copolymer of an ester compound having a vinyl group, such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate and 2-ethylhexyl methacrylate (a vinyl series resin); a homopolymer or a copolymer of a vinylnitrile compound, such as acrylonitrile and methacrylonitrile (a vinyl series resin); a homopolymer or a copolymer of a vinyl ether compound, such as vinyl methyl ether and vinyl isobutyl ether (a vinyl series resin); a homopolymer or a copolymer of a vinyl ketone compound, such as vinyl methyl ketone, vinyl ethyl ketone and vinyl isopropenyl ketone (a vinyl series resin); a homopolymer or a copolymer of an olefin compound, such as ethylene, propylene, butadiene and isoprene (an olefin series resin); a non-vinyl condensation series resin, such as an epoxy resin, a polyester resin, a polyurethane resin, a polyamide resin, a cellulose resin and a polyether resin; and a graft polymer of the non-vinyl condensation series resin and the vinyl series resin. The resins may be used singly or in combination of two or more of them.

Among these resins, a styrene series resin, a vinyl series resin, a polyester series resin and an olefin series resin are preferred, and a copolymer of styrene and n-butyl acrylate, a copolymer of n-butyl acrylate, bisphenol A and fumaric acid, and a copolymer of styrene and an olefin are particularly preferred.

The average particle diameter of the resin particles is generally 1 μm or less, and preferably from 0.01 to 1 μm. When the average particle diameter exceeds 1 μm, the toner particles finally obtained exhibit a broad particle diameter distribution, and free particles are formed, whereby it is liable to cause deterioration in performance and reliability. On the other hand, when the average particle diameter is in the range, such problems do not occur, and also it is advantageous in that mal-distribution of the toner is decreased, and the state of dispersion of the toner is improved, so as to decrease scattering in performance and reliability. The average particle diameter can be measured by using a Coulter counter.

In the case where a colored fine particle dispersion is not used as the fine particle dispersion in the second step described later, it is necessary that a coloring agent be dispersed in the dispersion. In this case, the coloring agent may be dispersed in a dispersion containing resin particles dispersed therein, or in alternative, a dispersion obtained by dispersing the coloring agent is mixed with a dispersion containing resin particles dispersed therein.

Examples of the coloring agent include various pigments, such as carbon black, Chrome Yellow, Hansa Yellow, Benzidine Yellow, Suren Yellow, Quinoline Yellow, Permanent Orange GTR, Pyrazolone Orange, Vulcan Orange, Watchung Red, Permanent Red, Brilliant Carmine 3B, Brilliant Carmine 6B, Du Pont Oil Red, Pyrazolone Red, Lithol Red, Rhodamine B Lake, Lake Red C, Rose Bengal, Aniline Blue, Ultramarine Blue, Carcoil Blue, Methylene Blue Chloride, Phthalocyanine Blue, Phthalocyanine Green and Malachite Green Oxalate; and various dyes, such as acridine series, xanthene series, azo series, benzoquinone series, azine series, anthraquinone series, dioxane series, thiazine series, azomethine series, indigo series, thioindigo series, phthalocyanine series, aniline black series, polymethine series, triphenylmethane series, thiazine series, thiazole series and xanthene series. The coloring agent may be used singly or in combination of two or more of them.

The average particle diameter of the coloring agent is generally 1 μm or less, and preferably from 0.01 to 1 μm. When the average particle diameter exceeds 1 μm, the toner particles finally obtained exhibit a broad particle diameter distribution, and free particles are formed, whereby it is liable to cause deterioration in reliability. On the other hand, when the average particle diameter is in the range, such problems do not occur, and also it is advantageous in that mal-distribution of the toner is decreased, and the state of dispersion of the toner is improved, so as to decrease scattering in performance and reliability. The average particle diameter can be measured by using a Coulter counter.

In the case where the coloring agent and the resin particles are used in combination in the dispersion, the combination is not particularly limited and can be appropriately selected depending on the object.

Other components, such as a releasing agent, an internal additive, a charge controlling agent, inorganic particles, a lubricating agent and an abrasive, may be dispersed in the dispersion depending on the object. In such cases, the other particles may be dispersed in the dispersion containing the resin particles dispersed therein, or in alternative, a dispersion obtained by dispersing the other particles is mixed with a dispersion containing resin particles dispersed therein.

Examples of the releasing agent include a low molecular weight polyolefin, such as polyethylene, polypropylene and polybutene; silicone having a softening point under heating; an aliphatic amide, such as oleic acid amide, erucic acid amide, ricinoleic acid amide and stearic acid amide; vegetable wax, such as carnauba wax, rice wax, candelilla wax, wood wax and jojoba oil; animal wax, such as bees wax; mineral or petroleum wax, such as montan wax, ozokerite, ceresin, paraffin wax, microcrystalline wax and Fischer-Tropsch wax; and a modification product thereof.

The wax can be formed into fine particles of 1 μm or less by dispersing in water along with a polymeric electrolyte, such as an ionic surface active agent, a polymeric acid and a polymeric base, and heated to a temperature exceeding the melting point, followed by treating with a homogenizer or a pressure discharging disperser that can apply a large sharing force.

Examples of the internal additive include a metal, an alloy and a compound containing the metal, such as a magnetic material, such as ferrite, magnetite, reduced iron, cobalt, nickel and manganese.

Examples of the charge controlling agent include a dye containing a complex, such as a quaternary ammonium salt compound, a nigrosine compound, aluminum, iron and chromium, and a triphenylmethane series pigment. The charge controlling agent is preferably those that is difficult to be dissolved in water from the standpoint of control of ion intensity, which influences the stability on aggregation and fusion, and reduction in pollution due to waste water.

Examples of the inorganic particles include any particles that are generally used as an external additive on the surface of a toner, such as silica, alumina, titania, calcium carbonate, magnesium carbonate, calcium phosphate and cerium oxide. Examples of the lubricating agent include an aliphatic amide, such as ethylene bisstearamide and oleic acid amide, and a metallic salt of an aliphatic acid, such as zinc stearate and calcium stearate. Examples of the abrasive include silica, alumina and cerium oxide exemplified in the foregoing.

The average particle diameter of the other components is generally 1 μm or less, and preferably from 0.01 to 1 μm. When the average particle diameter exceeds 1 μm, the toner particles finally obtained exhibit a broad particle diameter distribution, and free particles are formed, whereby it is liable to cause deterioration in performance and reliability. On the other hand, when the average particle diameter is in the range, such problems do not occur, and also it is advantageous in that mal-distribution of the toner is decreased, and the state of dispersion of the toner is improved, so as to decrease scattering in performance and reliability. The average particle diameter can be measured by using a Coulter counter.

Examples of a dispersing medium of the dispersion include an aqueous medium. Examples of the aqueous medium include water, such as distilled water and ion exchanged water, and an alcohol. These may be used singly or in combination of two or more of them. It is preferred that a surfactant is added and mixed with the aqueous medium.

Examples of the surfactant include an anionic surfactant, such as sulfate series, sulfonate series, phosphate series and soap series; a cationic surface active agent, such as an amine salt type and a quaternary ammonium salt type; and a nonionic surfactant, such as polyethylene glycol series, alkylphenol ethyleneoxide adduct series and polyvalent alcohol series. Among these, an anionic surfactant and a cationic surfactant are preferred. The nonionic surfactant is preferably used in combination with the anionic surfactant or the cationic surfactant. The surfactant may be used singly or in combination of two or more of them. Specific examples of the anionic surfactant include sodium dodecylbenzenesulfonate, sodium dodecylsulfate, sodium alkylnaphthalenesulfonate and sodium dialkylsulfosuccinate. Specific examples of the cationic surfactant include alkylbenzenemethylammonium chloride, alkyltrimethylammonium chloride and distearylammonium chloride. Among these, an ionic surfactant, such as an anionic surfactant and a cationic surfactant, is preferred.

The content of the resin particles in the dispersion may be 40% by weight or less in the coagulated particle dispersion, and preferably about from 2 to 20% by weight. In the case where the coloring agent and the magnetic material are dispersed in the dispersion, the content of the coloring agent in the dispersion may be 50% by weight or less in the coagulated particle dispersion, and preferably about from 2 to 40% by weight.

In the case where the other components are dispersed in the dispersion, the content of the other components is generally a slight amount and may be about from 0.01 to 5% by weight in the coagulated particle dispersion, and preferably about from 0.5 to 2% by weight. When the content is outside the range, there are cases where the effect of addition of the other particles is not sufficient, or the particle size distribution is broadened to deteriorate the characteristics.

The dispersion containing the resin particles dispersed therein is prepared, for example, by the following manner. In the case where the resin is a homopolymer or a copolymer of an ester having a vinyl group, a vinylnitrile, a vinyl ether or a vinyl ketone (a vinyl series resin), the vinyl series monomer is subjected to emulsion polymerization or seed polymerization in an ionic surface active agent to prepare a dispersion containing a homopolymer or a copolymer of the vinyl series monomer (a vinyl series resin) dispersed in the ionic surfactant.

In the case where the resin of the resin particles is other resin than the vinyl series resin, and the resin is soluble in a lipophilic solvent that has a relatively low solubility in water, the resin is dissolved in the lipophilic solvent, and the resulting solution is dispersed into fine particles in water along with an ionic surfactant and a polymeric electrolyte by using a disperser, such as a homogenizer, followed by evaporating the lipophilic solvent by heating or reducing the pressure, so as to prepare a dispersion containing the resin particles of the other resin than the vinyl series resin dispersed in the ionic surfactant.

An apparatus for dispersing is not particularly limited and, for example, may be a known disperser, such as a rotation sharing type homogenizer, as well as a ball mill, a sand mill and a Dyno-mill containing a medium.

The coagulated particles are prepared, for example, by the following manner.

To a first dispersion containing the resin particles dispersed in an aqueous medium, to which an ionic surfactant has been added and mixed, (1) another ionic surfactant having the polarity opposite to the former ionic surfactant, (2) an aqueous medium containing the later ionic surfactant, or (3) a second dispersion containing the aqueous medium (2) is mixed. When the mixture is stirred, the resin particles and the other components are coagulated by the action of the ionic surfactant to form coagulated particles of the resin particles, and thus the coagulated particle dispersion is prepared. The mixing operation is preferably conducted at a temperature lower than the glass transition point of the resin contained in the mixture. By conducting the mixing operation under such a temperature condition, the coagulation can be conducted in a stable condition.

The second dispersion is a dispersion containing the resin particles, the coloring agent and/or the other particles dispersed therein. The stirring operation can be conducted by using a known stirring apparatus, such as a homogenizer and a mixer.

In the case of (1) or (2) above, the resin particles contained in the first dispersion are coagulated to form coagulated particles. The content of the resin particles in the first dispersion in this case is generally from 5 to 60% by weight, and preferably from 10 to 40% by weight. The content of the coagulated particles in the coagulated particle dispersion after forming the coagulated particles is generally 40% by weight or less.

In the case of (3) above where the particles dispersed in the second dispersion are the resin particles, the resin particles contained in the second dispersion and the resin particles contained in the first dispersion are coagulated to form coagulated particles. On the other hand, in the case where the particles dispersed in the second dispersion are the coloring agent and/or the other particles, these and the resin particles dispersed in the first dispersion are subjected to hetero-coagulation to form coagulated particles. In the case where the particles dispersed in the second dispersion are the resin particles and the coloring agent and/or the other particles, these and the resin particles contained in the first dispersion are coagulated to form coagulated particles.

The content of the resin particles in the first dispersion in this case is generally from 5 to 60% by weight, and preferably from 10 to 40% by weight, and the content of the resin particles, the coloring agent and/or the other particles in the second dispersion is generally from 5 to 60% by weight, and preferably from 10 to 40% by weight. When the content is outside the range, there are cases where the particle size distribution is broadened to deteriorate the characteristics. The content of the coagulated particles in the coagulated particle dispersion after forming the coagulated particles is generally 40% by weight or less.

In the case where the coagulated particles and the adhered particles are formed, the polarities of the ionic surfactant contained in the dispersion to be added and the ionic surfactant contained in the dispersion, to which the first dispersion is added, are made opposite to each other, so as to change the balance of the polarity.

The average particle diameter of the coagulated particles formed is not particularly limited and is generally controlled to such a particle diameter that is substantially equivalent to the average particle diameter of the toner particles to be obtained. The control of the particle diameter can be easily conducted, for example, by appropriately setting and changing humidity and the conditions of the stirring and mixing.

According to the first step described in the foregoing, the coagulated particles having the substantially same average particle diameter as the average particle diameter of the toner particles are formed, and the coagulated particle dispersion having the coagulated particles dispersed therein is prepared. The coagulated particles may be sometimes called as mother particles.

(Second Step)

In the second step, a fine particle dispersion containing fine particles dispersed therein is added and mixed with the coagulated particle dispersion to adhere the fine particles to the coagulated particles, so as to form adhered particles. (Hereinafter, the second step is sometimes called as an adhering step.)

Examples of the fine particles include resin-containing fine particles, inorganic fine particles, coloring agent fine particles, releasing agent fine particles, intercalation fine particles and charge controlling agent fine particles.

The resin-containing fine particles are fine particles containing at least one of the resins described in the foregoing. They may be resin fine particles containing at least one of the resin at 100% by weight and may be composite fine particles containing at least one of the resins and at least one of the coloring agent, the inorganic particles, the releasing agent, the internal additive and the charge controlling agent. Among the composite fine particles, composite particles containing at least one of the resins and at least one kind of the coloring agent (i.e., resin-coloring agent fine particles) are preferred.

The inorganic fine particles are fine particles containing at least one kind of the inorganic particles. The coloring agent fine particles are fine particles containing at least one kind of the coloring agent. The releasing agent fine particles are fine particles containing at least one kind of the releasing agent. The internal additive fine particles are fine particles containing at least one kind of the internal additive. The charge controlling agent fine particles are fine particles containing at least one kind of the charge controlling agent.

Among these fine particles, the resin-containing fine particles, the inorganic fine particles, the coloring agent fine particles and the releasing agent fine particles are preferred.

The resin-containing fine particles are suitably used, for example, for producing multi-color toner particles. When the resin-containing fine particles are used, because a layer of the resin-containing fine particles is formed on the surface of the coagulated particles formed by coagulating the resin particles and the coloring agent particles, the influence of the coloring agent to the charging behavior can be minimized, and the variation in charging characteristics depending on the species of the coloring agent can be difficult to occur. When a resin having a high glass transition point is selected as the resin of the resin-containing fine particles, toner particles satisfying both the thermal storage property and the fixing property can be obtained.

When the resin-containing fine particles (the composite fine particles of the resin and the coloring agent) are used and are adhered on the coagulated particles, toner particles having a more complex hierarchical layer structure can be produced. When the inorganic fine particles are used and adhered on the coagulated particles, toner particles having a structure that is capsuled by a layer of the inorganic fine particles are obtained after the fusion in the third step.

The average particle diameter of the fine particles is generally 1 $\mu$m or less, and preferably from 0.01 to 1 $\mu$m. When the average particle diameter exceeds 1 $\mu$m, the toner particles finally obtained exhibit a broad particle diameter distribution, and free particles are formed, whereby it is liable to cause deterioration in performance and reliability. On the other hand, when the average particle diameter is in the range, such problems do not occur, and also it is advantageous in that mal-distribution of the toner is decreased, and the state of dispersion of the toner is improved, so as to decrease scattering in performance and reliability. The average particle diameter can be measured by using a Coulter counter.

The volume of the fine particles depends on the volume fraction of the toner particles obtained and is preferably 50% or less of the volume of the toner particles. When the volume of the fine particles exceeds 50% of the volume of the toner particles, it is not preferred since the fine particles are not adhered and coagulated to the coagulated particles but coagulated particles of the fine particles are formed, whereby there are cases where the variation of the compositional distribution and the particle diameter distribution of the resulting toner particles becomes large, and the desired performance cannot be obtained.

In the fine particle dispersion, one kind of the fine particles is solely dispersed, or two or more kinds of them may be dispersed in combination. In the later case, the combination of the fine particles is not particularly limited and can be appropriately selected depending on the object.

Examples of a dispersion medium of the fine particle dispersion include the aqueous medium described in the foregoing. It is preferred that at least one kind of the surfactant described in the foregoing is added and mixed with the aqueous medium.

The content of the fine particles in the fine particle dispersion is generally from 5 to 60% by weight, and preferably from 10 to 40% by weight. When the content is outside the range, there are cases where the control of the structure and the composition from the interior toward the surface of the toner particles are not sufficient. The content of the coagulated particles in the coagulated particle dispersion upon forming the coagulated particles is generally 40% by weight or less.

The fine particle dispersion is prepared, for example, by dispersing the fine particles in an aqueous medium, to which an ionic surfactant has been added and mixed. The fine particle dispersion having the composite fine particles dispersed therein is prepared in such a manner that at least one kind of the resin and at least one kind of the pigment are dissolved in the solvent, and the resulting solution is dispersed into fine particles in water along with an ionic surfactant or a polymeric electrolyte by using a disperser, such as a homogenizer, followed by removing the solvent by heating or reducing the pressure. It may also be prepared by adsorbing by mechanical sharing force or electric force on the surface of latex formed by emulsion polymerization or seed polymerization, followed by fixing.

In the second step, the fine particle dispersion is added and mixed with the coagulated particle dispersion prepared in the first step, and the fine particles are adhered on the coagulated particles to form adhered particles. Since the fine particles are those further added from the standpoint of the coagulated particles, they are sometimes called as additional particles.

The method for adding and mixing is not particularly limited and for example, the operation may be conducted gradually and continuously or may be conducted stepwise as separated into plural steps. By adding and mixing the fine particles (additional particles), formation of minute particles is suppressed to make sharp the particle diameter distribution of the toner particles.

When the addition and mixing are conducted stepwise as separated into plural steps, layers of the fine particles are stepwise accumulated on the surface of the coagulated particles, so as to produce structural change and compositional gradient from the interior to the surface of the toner particles, and the surface hardness of the particles can be improved. Furthermore, the particle diameter distribution can be maintained upon fusing in the third step to suppress the change thereof, and the addition of a surfactant or a stabilizer, such as a base or an acid, for improving the stability on fusing can be omitted or the addition amount thereof can be suppressed to the minimum level. Thus, the stepwise addition is advantageous from the standpoint of suppress of the cost and improvement in quality.

The conditions under which the fine particles are adhered to the coagulated particles are as follows.

The temperature is lower than the glass transition point of the resin of the resin particles in the first step, and preferably about room temperature. When heating at a temperature lower than the glass transition point, the coagulated particles and the fine particles are liable to be adhered, and as a result, the adhered particles formed are liable to be stabilized.

The processing time cannot be solely determined because it depends on the temperature and is generally from 5 minutes to 2 hours. Upon adhering, the dispersion containing the coagulated particles and the fine particles may be stood still or may be moderately stirred by a mixer. The later case is advantageous because uniform adhered particles can be formed.

The number of times of conducting the second step may be one time or plural times. In the former case, only one layer of the fine particles (additional particles) is formed on the surface of the coagulated particles, whereas in the later case, two or more layers of the fine particles (additional particles) are formed on the coagulated particles. Therefore, toner particles having a complex and accurate hierarchical structure can be obtained in the later case, and it is advantageous from such a standpoint that desired functions can be imparted to the toner particles.

In the case where the second step is conducted in plural times, the combination of the fine particles adhered to the coagulated particles at the first time and the fine particles subsequently adhered may be any combination and can be appropriately selected depending on the purpose and object of the toner particles.

For example, a combination where the releasing agent fine particles and resin-containing fine particles are adhered in this order, a combination where the coloring agent fine particles and the resin-containing fine particles are adhered in this order, the resin-containing fine particles and the inorganic fine particles are adhered in this order, and a combination where the releasing agent fine particles and the inorganic fine particles are adhered in this order are preferred.

In the case of the combination where the releasing agent fine particles and the resin-containing fine particles are adhered in this order, because a layer of the resin-containing fine particles is present as the outermost surface of the toner particles, the releasing agent fine particles are not exposed to the surface of the toner particles but are present in the vicinity of the surface of the particles. Accordingly, the releasing agent fine particles can be liberated upon fixing while suppressing the exposure of the releasing agent particles.

In the case of the combination where the coloring agent fine particles and the resin-containing fine particles are adhered in this order, because a layer of the resin-containing fine particles is present as the outermost surface of the toner particles, the coloring agent fine particles are not exposed to the surface of the toner particles but are present in the vicinity of the surface of the particles. Accordingly, drop off of the coloring agent fine particles from the surface of the particles can be suppressed.

In the case where the resin-containing fine particles and the inorganic fine particles are adhered in this order, because a layer of the inorganic fine particles is present as the outermost surface of the toner particles, toner particles having a structure capsuled by the layer of the inorganic fine particles are obtained.

As other combinations, for example, when a combination where a releasing agent dispersion and resin-containing fine particles or inorganic fine particles having high hardness are adhered in this order is employed, a hard shell can be formed on the outermost surface of the toner particles.

In the case where the second step is conducted in plural times, it is preferred that the dispersion containing the fine particles and the coagulated particles is heated to a temperature lower than the glass transition point of the resin of the resin particles in the first step on each operation of adding and mixing the fine particles, and it is more preferred that the heating temperatures in each operation are increased step by step. By employing such an embodiment, it is advantageous since formation of free particles can be suppressed.

According to the second step described in the foregoing, the adhered particles containing the coagulated particles prepared in the first step having the fine particles adhered thereto are formed. In the case where the second step is conducted in plural times, the adhered particles containing the coagulated particles prepared in the first step having the fine particles adhered thereto in plural times. Therefore, when the fine particles that have been appropriately selected are adhered on the coagulated particles, toner particles having desired characteristics can be freely designed and produced.

(Third Step)

In the third step, the adhered particles are fused by heating. (Hereinafter, the third step is sometimes called as a fusing step.)

The temperature of heating may be from the glass transition point of the resin contained in the adhered particles to the decomposition temperature of the resin. Therefore, the temperature of heating depends on the species of the resin of the resin particles and cannot be determined unconditionally, but it is generally from the glass transition point of the resin contained in the adhered particles to 180° C.

The heating operation can be conducted by using known heating apparatus.

The period of time for fusing can be short when the temperature of heating is high, and a long period of time is required when the temperature of heating is low. The period of time of fusing thus depends on the temperature of heating and cannot be determined unconditionally, but it is generally from 30 minutes to 10 hours.

The toner particles obtained after completing the third step can be washed and dried under appropriate conditions. Inorganic particles, such as silica, alumina, titania and calcium carbonate, and resin particles, such as a vinyl series resin, a polyester resin and a silicone resin, may be added to the surface of the resulting toner particles by applying a sharing force under a dry condition. The inorganic particles and the resin particles function as an external additive, such as a fluidizing aid and a cleaning aid.

According to the third step described in the foregoing, the adhered particles prepared in the second step are fused in such a condition that the fine particles (additional particles) are adhered on the surface of the coagulated particles (mother particles), so as to produce the toner particles.

In the invention, the toner particles are not limited to those produced by the process described in the foregoing, but toner particles produced by known production processes, such as the suspension polymerization method, the dissolved suspension method, an emulsion polymerization method and a kneading and pulverization method, can also be employed.

Known external additives, such as inorganic fine particles and organic fine particles, can be used as the external additive, and among these, inorganic fine particles, such as silica, titania, alumina, cerium oxide, strontium titanate, calcium carbonate, magnesium carbonate and calcium phosphate, and organic resin fine particles, such as fluorine-containing resin fine particles, silica-containing resin fine particles and nitrogen-containing resin fine particles are preferred. The surface of the external additive may be subjected to a surface treatment depending on the object. Examples of the surface treating agent include a silane compound, a silane coupling agent and a silicone oil for a hydrophobic treatment.

With respect to the material and the particle diameter of the external additive, several kinds of external additives can be used in combination, for example, a combination of one having a relatively large particle diameter and one having relatively small particle diameter. Particularly, in order to prevent blocking of toner particles due to reduction in particle diameter of the toner particles for improvement of the image quality in recent years, it is preferred to use at least one kind of an external additive having a large particle diameter of 0.1 $\mu$m or more.

The external addition toner of the invention can be a magnetic one-component toner by replacing the whole or part of the coloring material by magnetic powder, and can be used as a one-component developer. Examples of the magnetic powder include magnetite, ferrite, and a simple metal or an alloy thereof, such as cobalt, iron and nickel.

The external addition toner of the invention can be used as a two-component developer by combining a carrier. In this case, the carrier is preferably a resin-coated carrier containing a core material having a resin coating layer thereon.

An electroconductive material may be dispersed in the coating resin or the matrix resin of the carrier. Examples of the coating resin and the matrix resin include polyethylene, polypropylene, polystyrene, polyacrylonitrile, polyvinyl acetate, polyvinyl alcohol, polyvinyl butyral, polyvinyl chloride, polyvinyl carbazole, polyvinyl ether, polyvinyl ketone, a vinyl chloride-vinyl acetate copolymer, a styrene-acrylic acid copolymer, a straight silicone resin containing an organosilixane bond and a modification product thereof, a fluorine resin, polyester, polyurethane, polycarbonate, a phenol resin, an amino resin, a melamine resin, a benzoguanamine resin, a urea resin, an amide resin and an epoxy resin, but it is not limited to these examples.

Examples of the electroconductive material contained in the resin include metallic powder, such as gold, silver and copper, and inorganic fine particles, such as carbon black, titanium oxide, zinc oxide, barium sulfate, aluminum borate, potassium titanate and tin oxide, but it is not limited to these examples.

Examples of the core material of the carrier include a magnetic metal, such as iron, nickel and cobalt, a magnetic oxide, such as ferrite and magnetite, and glass beads, and the magnetic material is preferred for adjusting the volume resistivity by using a magnetic brush method. With respect to the average particle diameter of the carrier, those having an average particle diameter of from 10 to 500 $\mu$m are generally employed, and preferably those having a spherical shape with an average particle diameter of from 30 to 100 $\mu$m are employed.

As describe later, the charge amount for transferring the toner with high efficiency varies depending on the volume average particle diameter of the toner particles. In the case of the two-component developer, what influences the charge amount of the toner is the material and the particle diameter of the carrier, and therefore, it is important to appropriately select the carrier that can be charged to a desired charge amount corresponding to the volume average particle diameter of the toner particles.

The apparatus for forming an image of the invention will be described in detail with reference to the drawings.

Figure 2:
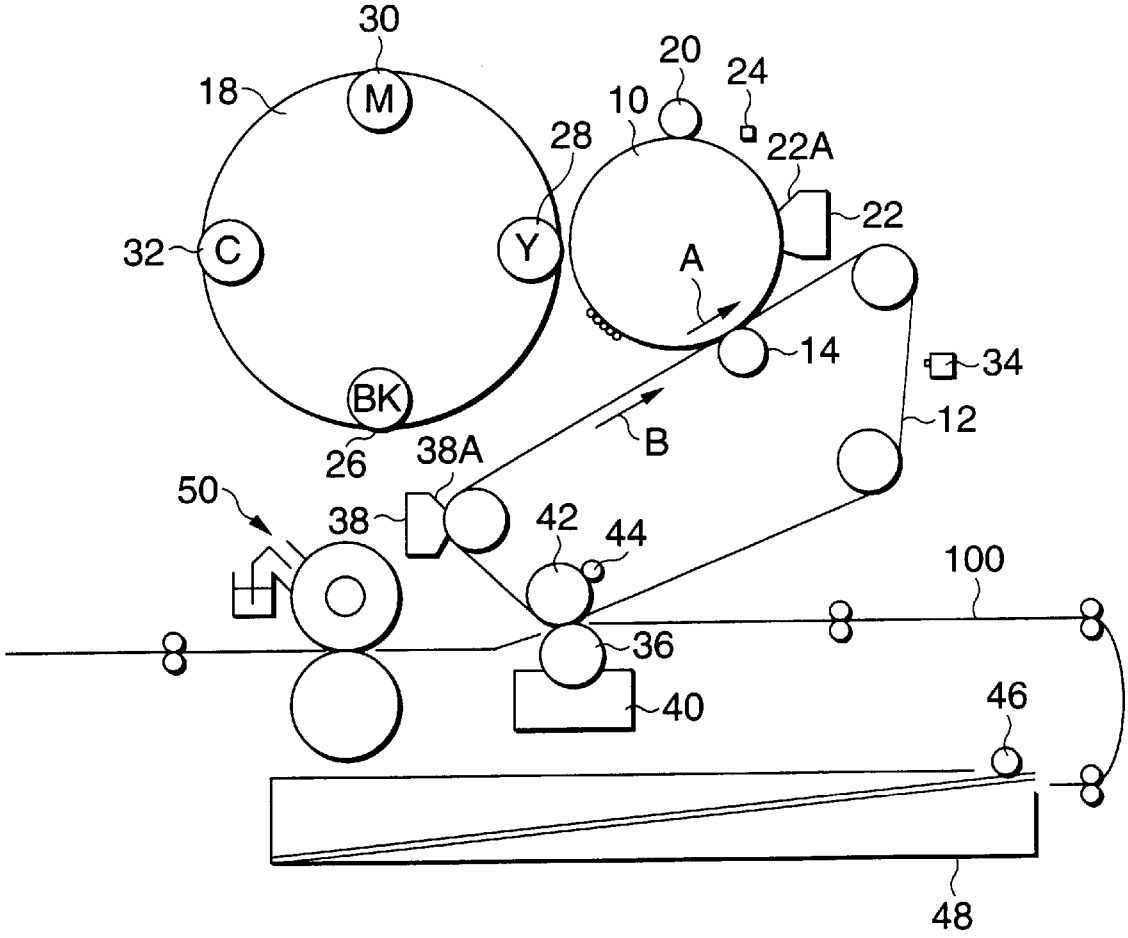
FIG. 2 is a schematic cross sectional view showing one embodiment of the apparatus for forming an image of the invention.

FIG. 2 is a schematic cross sectional view showing one embodiment of the apparatus for forming an image of the invention.

In FIG. 2, numeral 10 denotes a photoreceptor drum, 12 denotes an intermediate transfer belt, and the intermediate transfer belt 12 is stretched by hanging on plural support rolls to be in contact with the surface of the photoreceptor drum 10. On the side of the intermediate transfer belt 12 opposite to the photoreceptor drum 10, a primary transfer roll 14 made of foamed urethane rubber having a resistance of from $10^6$ to $10^8\Omega$ is arranged. The position where the photoreceptor drum 10 and the intermediate transfer drum 12 are in contact with each other is the primary transfer position.

A development rotor 18 is arranged around the photoreceptor drum 10 on the upstream of the primary transfer position, and a charger 20 is arranged on the upstream of the development rotor 18. A cleaner 22 having a blade 22A is arranged on the downstream of the primary transfer position, and a diselectrifier 24 is arranged on the downstream of the cleaner 22. On the development rotor 18, developing devices 26, 28, 30 and 32 each corresponding to the colors, black (BK), yellow (Y), magenta (M) and cyan (C) are arranged.

Around the intermediate transfer belt 12, on the other hand, a position detecting sensor 34 for detecting the position of the intermediate transfer belt 12 is provided on the downstream of the primary transfer position, and a bias roll 36 as a transfer member is provided on the downstream of the position detecting sensor 34. A cleaner 38 having a blade 38A is arranged on the downstream of the bias roll 36, and a cleaner 40 is arranged under the bias roll 36. On the side of the intermediate transfer belt 12 opposite to the bias roll 36, a backup roll 42 having a surface resistivity of from $10^7$ to $10^{11}\Omega$ per square is provided. The backup roll 42 is arranged to be in contact with an electrode roll 44 and also functions as a counter electrode of the bias roll 36. The bias roll 36 as a transfer member is a grounded electroconductive roll and preferably has a volume resistivity of $10^7\Omega$/cm or less for maintaining the surface potential equivalent to the potential of the grounded position.

Along the transporting path of a recording medium 100, paper feeding tray 48 equipped with a feeding roller 46 is provided on the upstream of the bias roll 36. On the downstream of the bias roll 36, a fixing device 50 for fixing an unfixed toner image on the recording medium 100 is provided.

Figure 3:
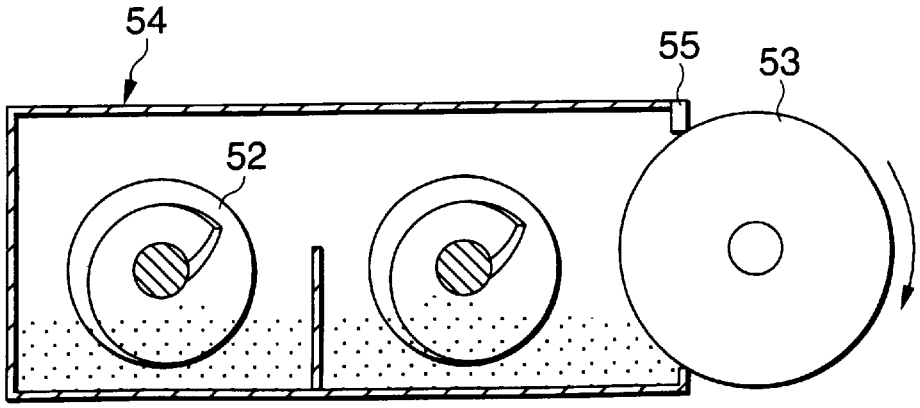
FIG. 3 is a schematic diagram showing one embodiment of the part of the developing device of the apparatus for forming an image of the invention.

The developing devices 26, 28, 30 and 32 each as shown in FIG. 3, has a developer maintaining part 54 having a stirring device 52. In the figure, numeral 53 denotes a developing roll, and 55 denotes a layer restricting member. In the case of the two-component developer, the toner is stirred with the carrier in the developer maintaining part 54 by the stirring device 52 to be charged by friction with the carrier. In the invention, the toner is charged to a charge amount q ($\mu$C/g) satisfying the following equation (3) corresponding to the volume average particle diameter D ($\mu$m) of the toner particles:

$$q \geqq 929.5/D^2 \tag{3}$$

That is, the image force of the toner particles charged to a charge amount q ($\mu$C/g) is in proportion to $(q/D)^2$. The image force of the toner particles corresponds to the electrostatic attractive force between the toner particles charged to a prescribed charge amount and the image holding member, and when the toner particles having a volume average particle diameter D1 and the toner particles having volume average particle diameter D2 are charged to the same charge amount, the ratio of the image force of the toner particles is $(D2)^2/(D1)^2$ as shown by the following equation:

$$\frac{\text{Image force of toner particles of volume average particle diameter of } D1}{\text{Image force of toner particles of volume average particle diameter of } D2} = \left(\frac{D2}{D1}\right)^2$$

That is, the toner particles having a volume average particle diameter of D1 are attracted at an image force of $(D2/D1)^2$ times that of the toner particles having a volume average particle diameter of D2, and in order to transfer it, force of $(D2/D1)^2$ times that for the toner particles having a volume average particle diameter of D2 is required.

For example, when toner particles having a volume average particle diameter of 5.2 $\mu$m and toner particles having a volume average particle diameter of 6.5 $\mu$m are charged to the same charge amount, the toner particles having a volume average particle diameter of 5.2 $\mu$m are attracted to the surface of the image holding member with an image force of 1.56 times that of the toner particles having a volume average particle diameter of 6.5 $\mu$m, and in order to transfer it, force of 1.56 times that for the toner particles having a volume average particle diameter of 6.5 $\mu$m is required.

$$\frac{\text{Image force of toner particles of volume average particle diameter of } 5.2\ \mu\text{m}}{\text{Image force of toner particles of volume average particle diameter of } 6.5\ \mu\text{m}} = \left(\frac{6.5}{5.2}\right)^2 = 1.56$$

On the other hand, in a constant transfer electric field, a force F required for transfer is proportional to a charge amount q. Therefore, in order to transfer the toner particles having a volume average particle diameter D1 and the toner particles having a volume average particle diameter D2 with the same transfer force, the charge amount q1 of the toner particles having a volume average particle diameter D1 is made $(D2/D1)^2$ times the charge amount q2 of the toner particles having a volume average particle diameter D2 as shown in the following equation:

$$\frac{\text{Charge amount } q1 \text{ of toner particles of volume average particle diameter of } D1}{\text{Charge amount } q2 \text{ of toner particles of volume average particle diameter of } D2} = \left(\frac{D2}{D1}\right)^2$$

It has been confirmed by experiments that when toner particles having a volume average particle diameter of 6.5 $\mu$m are charged to a charge amount of −22 $\mu$C/g, high transfer efficiency can be obtained, and transfer failure, such as drop off and transfer unevenness, does not occur, i.e., sufficient transfer performance can be imparted to the toner. It is understood from the above that a charge amount for imparting sufficient transfer performance to a toner using toner particles having a volume average particle diameter D ($\mu$m) can be expressed by the following equation based on the data of the toner having a volume average particle diameter of 6.5 $\mu$m.

$$\begin{aligned}\text{Charge amount } q \text{ of toner particles of volume average particle diameter } D &= \left(\frac{6.5}{D}\right)^2 \times \text{Charge amount of toner particles of volume average particle diameter of } 6.5\ \mu\text{m} \\ &= \left(\frac{6.5}{D}\right)^2 \times (-22\ \mu\text{C/g}) \\ &= \frac{-929.5}{D^2}\ \mu\text{C/g}\end{aligned}$$

Therefore, in order to obtain good transfer performance, it is necessary that the toner is charged to a charge amount q ($\mu$C/g) satisfying $q \geqq 929.5/D^2$ corresponding to the volume average particle diameter D ($\mu$m) of the toner particles.

Figure 4:
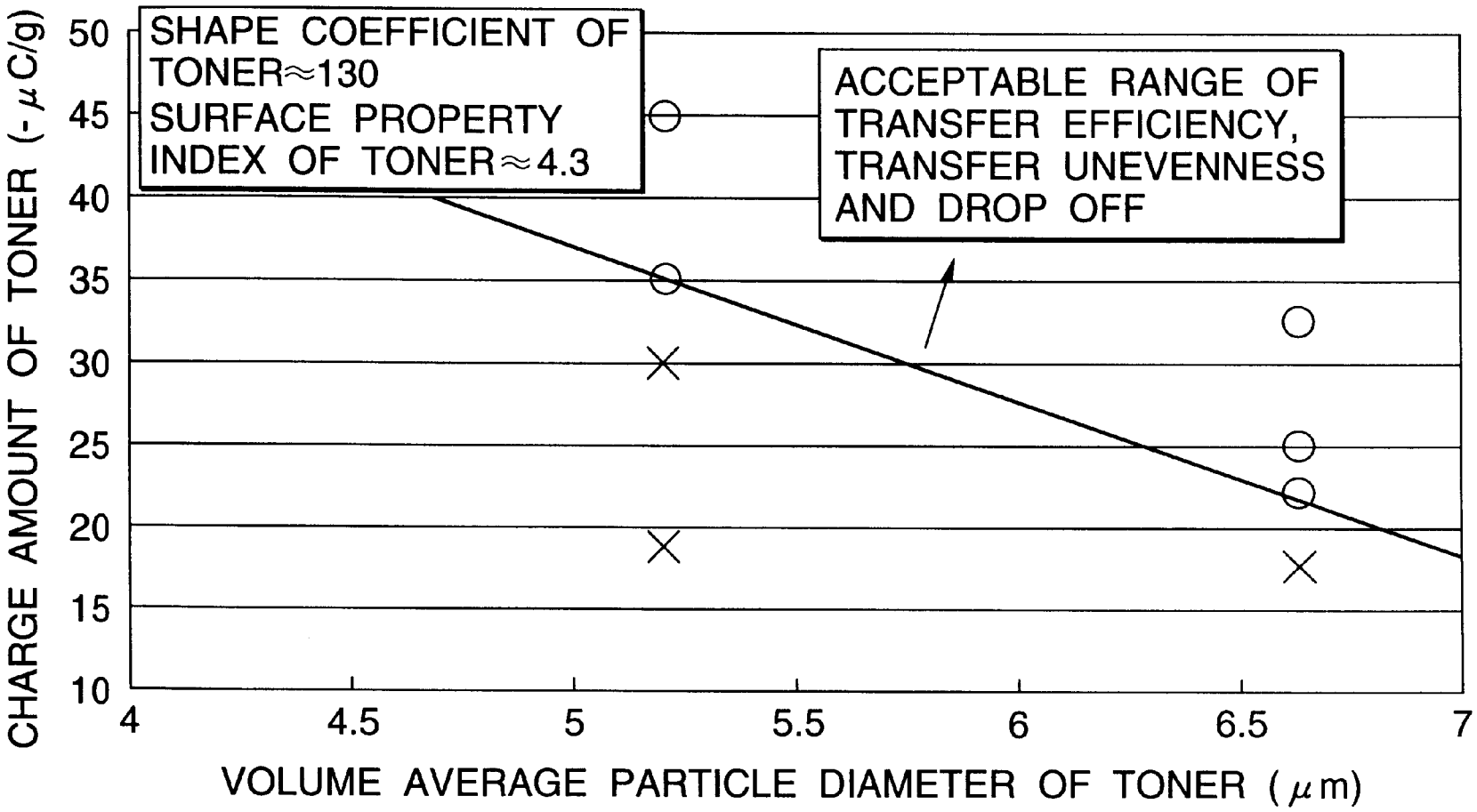
FIG. 4 is a graph showing the relationship between the volume average particle diameter and the charge amount of toner particles.

The relationship between the volume average particle diameter D ($\mu$m) and the charge amount q ($\mu$C/g) is shown in FIG. 4. In FIG. 4, the region above the straight line is the acceptable range from the standpoint of transfer performance. It is understood from FIG. 4 that when the volume average particle diameter of the toner particles is 5.2 ($\mu$m), the minimum charge amount is −34.4 ($\mu$C/g).

The developing devices 26, 28, 30 and 32 may be selected depending on the type of the developers and may be any of known developing devices, such as a two-component magnetic brush developing device, a one-component magnetic brush developing device and a one-component non-magnetic developing device. In the case where a one-component developer is used, the toner is charged by friction in contact with a blade provided on the developing device.

In order to assist transfer of the toner, the intermediate transfer belt 12 preferably has a material constituting the surface thereof that has a contact angle with water of 75° or more, and more preferably 90° or more.

The intermediate transfer belt may have either a single layer structure or a multi-layer structure. As a material of the intermediate transfer belt, a resin, such as polyimide, polyamide, polycarbonate, polyester, urethane, nylon, acryl and vinyl chloride, is employed. In the case where the multi-layer structure is employed, it is preferred that a fluorine resin or a polyester resin having a fluorine resin dispersed as fine particles therein is used as the transfer surface. In order to impart electroconductivity, a conducting agent, such as carbon black and a metallic oxide, is added to each layer.

The thickness of the intermediate transfer belt is preferably from 50 to 500 $\mu$m, and more preferably from 60 to 150 $\mu$m. The volume resistivity thereof is preferably in the range of from $10^8$ to $10^{14}\Omega\cdot$cm. The surface resistivity thereof on the transfer surface is preferably in the range of from $10^9$ to $10^{12}\Omega\cdot$cm.

The operation of the apparatus for forming an image of the invention shown in FIG. 2 will be described.

The surface of the photoreceptor drum 10 charged to a prescribed dark potential by the charger 20 is irradiated with a light beam from an image exposure unit (not shown in the figure) under control of exposure timing of the image exposure unit corresponding to image information in a controlling part (not shown in the figure) of the apparatus for forming an image, based on a position detecting signal output from the position detecting sensor 34 of the intermediate transfer material following the rotation of the photoreceptor drum 10 in the direction of the arrow A, so as to form an electrostatic latent image on the photoreceptor drum 10.

The electrostatic latent image formed on the photoreceptor drum 10 is developed by one of the developing devices to form a toner image T. For example, in the case where the electrostatic latent image written in the photoreceptor drum 10 is one corresponding to yellow image information, the electrostatic latent image is developed by the developing device 28 containing a yellow (Y) toner, and a yellow toner image T is formed on the photoreceptor drum 10.

The unfixed toner image T formed on the photoreceptor drum 10 is electrostatically attracted to the intermediate transfer belt 12 by applying to the primary transfer roll 14 a voltage of the opposite polarity to the charge polarity of the toner, and thus is subjected to primary transfer from the photoreceptor drum 10 to the surface of the intermediate transfer belt 12 under the timing controlled by the output signal from the position detecting sensor 34. The nip pressure between the photoreceptor drum 10 and the intermediate transfer belt 12 is preferably from 1.1 to 1.5 gf/mm in terms of linear pressure from the standpoint of improvement in transfer property.

In the case where a monochrome image is formed, the unfixed toner image T transferred to the intermediate transfer belt 12 is immediately subjected to secondary transfer to the recording medium 100. In the case where a color image is formed by accumulating plural toner images of plural colors, the procedures of formation of the toner image on the photoreceptor drum 10 and the primary transfer of the toner image are repeated in times of the number of colors.

For example, in the case where a full color image accumulating four color toner images is formed, unfixed toner images T of black, yellow, magenta and cyan each is formed on the photoreceptor drum 10 per one rotation of the drum, and the unfixed toner images T are subjected to primary transfer to the intermediate transfer belt 12 one by one. The intermediate transfer belt 12, which carries the black unfixed toner image T firstly transferred, rotates in the direction of the arrow B at the same cycle as the photoreceptor drum 10, and the yellow, magenta and cyan unfixed toner images T each is transferred as accumulated on the black unfixed toner image T per one cycle. After completing the primary transfer, the toner remaining on the photoreceptor drum 10 is removed by the cleaner 22 for the photoreceptor drum 10 before the next cycle, and then the photoreceptor drum 10 is diselectrified by the diselectrifier 24.

The unfixed toner image T primarily transferred to the intermediate transfer belt 12 is transported by the rotation of the intermediate transfer belt 12 to the secondary transfer position facing the transporting path of the recording medium 100. At the secondary transfer position, the semi-conductive bias roll 36 is in contact with the intermediate transfer belt 12, and the recording medium 100 exported from the paper feeding tray 48 by the feeding roller 46 at prescribed timing is inserted between the bias roll 36 and the intermediate transfer belt 12.

At the secondary transfer position, a transfer voltage of a polarity contrary to the charge polarity of the toner is applied to the bias roll 36 from a power source (not shown in the figure), and the unfixed toner image T carried on the intermediate transfer belt 12 is electrostatically transferred to the recording medium 100 at the timing controlled based on the output signal from the position detecting sensor 34. The voltage for the secondary transfer is about from 1 to 6 kV, which is applied by connecting the power source (not shown in the figure) to a core metal of the backup roll 42 or the electrode roll 44 pressed on the roll 42, or in alternative by connecting to the bias roll 36. The nip pressure between the intermediate transfer belt 12 and the bias roll 36 is preferably 10 gf/mm or more in terms of linear pressure from the standpoint of improvement in transfer property, and more preferably from 12 to 17 gf/mm.

The recording medium 100, on which the unfixed toner image is transferred, is peeled off from the intermediate transfer material with a peeling claw (not shown in the figure) and transported to the fixing device 50 to conduct the fixing process of the unfixed toner image. After completing the secondary transfer of the unfixed toner image, the toner remaining on the intermediate transfer belt 12 is removed by the cleaner 38.

While the apparatus for forming an image using the intermediate transfer belt as the intermediate transfer material has been described, the apparatus for forming an image of the invention may be constituted as an apparatus for forming an image using an intermediate transfer drum as the intermediate transfer material. The intermediate transfer drum may contain a cylindrical substrate formed with aluminum, stainless steel (SUS) or copper, having coated thereon the materials similar to the intermediate transfer belt. The invention can be applied to an apparatus for forming a color image of a tandem type containing a developing device and a photoreceptor for each toners of black, yellow, magenta and cyan, instead of the single photoreceptor.

EXAMPLE 1

(Preparation of External Addition Toner)

(Preparation of Dispersion (1))

| | |
|---|---|
| Styrene | 370 g |
| n-Butyl acrylate | 30 g |
| Acrylic acid | 8 g |
| Dodecanethiol | 24 g |
| Carbon tetrabromide | 4 g |

A solution obtained by dissolving the components described above is dispersed and emulsified in 550 g of ion exchanged water, in which 6 g of a nonionic surfactant (Nonipol 400, produced by Sanyo Chemical Industries, Ltd.) and 10 g of an anionic surfactant (Neogen SC, produced by Daiichi Kogyo Seiyaku Co., Ltd.) have been dissolved, in a flask. 50 g of ion exchanged water, in which 4 g of ammonium persulfate has been dissolved, is added thereto over 10 minutes under slowly stirring, and after conducting nitrogen substitution, it is heated over an oil bath under stirring the content of the flask until the content of the flask reaches 70° C., followed by continuing the emulsion polymerization for 5 hours under the conditions.

As a result, a dispersion (1) containing resin particles having an average particle diameter of 155 nm, a glass transition point of 59° C. and a weight average molecular weight (Mw) of 12,000 dispersed therein is prepared.

(Preparation of Dispersion (2))

| | |
|---|---|
| Styrene | 280 g |
| n-Butyl acrylate | 120 g |
| Acrylic acid | 8 g |

A solution obtained by dissolving the components described above is dispersed and emulsified in 550 g of ion exchanged water, in which 6 g of a nonionic surfactant (Nonipol 400, produced by Sanyo Chemical Industries, Ltd.) and 12 g of an anionic surfactant (Neogen SC, produced by Daiichi Kogyo Seiyaku Co., Ltd.) have been dissolved, in a flask. 50 g of ion exchanged water, in which 3 g of ammonium persulfate has been dissolved, is added thereto over 10 minutes under slowly stirring, and after conducting nitrogen substitution, it is heated over an oil bath under stirring the content of the flask until the content of the flask reaches 70° C., followed by continuing the emulsion polymerization for 5 hours under the conditions. Thus, a dispersion (2) containing resin particles having an average particle diameter of 105 nm, a glass transition point of 53° C. and a weight average molecular weight (Mw) of 550,000 dispersed therein is prepared.

(Preparation of Coloring Agent Dispersion (1))

| | |
|---|---|
| Carbon black (Mogul L, produced by Cabot Inc.) | 50 g |
| Nonionic surfactant (Nonipol 400, produced by Sanyo Chemical Industries, Ltd.) | 5 g |
| Ion exchanged water | 200 g |

The components above are mixed and dissolved, and it is subjected to a dispersion treatment for 10 minutes by using a homogenizer (Ultra-Turrax T50, produced by Ika Works, Inc.), so as to prepare a coloring agent dispersion (1) containing a coloring agent (carbon black) having an average particle diameter of 250 nm.

(Preparation of Releasing Agent Dispersion (1))

| | |
|---|---|
| Paraffin wax (HNP0190, produced by Nippon Seiro Co., Ltd., melting point: 85° C.) | 50 g |
| Cationic surfactant (Sanisol B50, produced by Kao Corp.) | 5 g |
| Ion exchanged water | 200 g |

The components above are heated to 95° C. and dispersed by using a homogenizer (Ultra-Turrax, produced by Ika Works, Inc.), and it is then subjected to a dispersion treatment by a pressure discharging type homogenizer, so as to prepare a releasing agent dispersion (1) containing a releasing agent having an average particle diameter of 550 nm.

(Preparation of Coagulated Particles)

| | |
|---|---|
| Dispersion (1) | 120 g |
| Dispersion (2) | 80 g |
| Coloring agent dispersion (1) | 30 g |
| Releasing agent dispersion (1) | 40 g |
| Cationic surfactant (Sanisol B50, produced by Kao Corp.) | 1.5 g |

The components above are mixed and dispersed in a stainless steel round flask by using a homogenizer (Ultra-Turrax, produced by Ika Works, Inc.), and then heated over an oil bath for heating to 46° C. under stirring the content of the flask. The content of the flask is maintained at 46° C. for 30 minutes, which is then observed with an optical microscope. It is thus confirmed that coagulated particles having an average particle diameter of about 4.5 μm are formed.

(Preparation of Adhered Particles)

60 g of the dispersion (1) as the resin-containing fine particle dispersion is gradually added thereto. The temperature of the oil bath for heating is risen to 48° C and maintained for 1 hour. When it is observed with an optical microscope, it is confirmed that adhered particles having an average particle diameter of about 5.1 μm are formed.

Thereafter, after adding 3 g of an anionic surfactant (Neogen SC, produced by Daiichi Kogyo Seiyaku Co., Ltd.) thereto, the stainless steel flask is sealed and heated to 105° C. while continuously stirring by using a magnetic seal, followed by maintaining for 3 hours. After cooling, the reaction product is filtered out, and it is sufficiently washed with ion exchanged water and then dried to obtain toner particles having a shape coefficient of 124, a surface property index of 4.0 and a volume average particle diameter of 5.2 μm.

Separately, toner particles having different shape coefficients of 130, 134 and 138 are obtained in the same manner except that the heating temperature and the heating time in the final step are changed. All the toner particles have a surface property index of 4.0 and a volume average particle diameter of 5.2 μm.

(Evaluation)

An external additive containing silica and titania is coated on the resulting four kinds of toner particles. Among the external additive coated, the volume average particle diameter of the external additive (silica) having the maximum average particle diameter is 0.15 (μm), the coating ratio x of the external additive having the maximum average particle diameter to the surface area of the toner particles is 20%, and the shape coefficient after coating is 109.8798.

The external addition toner is mixed with a resin coated ferrite carrier having an average particle diameter of 35 μm to produce a developer. The transfer performance is evaluated by using the developer on a modified "A-Color" produced by Fuji Xerox Co., Ltd. having the constitution similar to the apparatus for forming an image shown in FIG. 2. The charge amount of the toner at this time is −35 μC/g.

The evaluation of the transfer performance is conducted by the transfer efficiency on the secondary transfer from the intermediate transfer belt and the evaluation of image quality of the resulting image as described below. The specific evaluation methods will be described below.

In order to obtain the transfer efficiency, a solid image of 100 $cm^2$ is formed on ordinary paper, and the weight of the toner on the photoreceptor is measured before and after the transfer of the image. The transfer efficiency is obtained from (1−(toner amount on photoreceptor after transfer)/(toner amount on photoreceptor after transfer))×100. The transfer efficiency on the secondary transfer means the transfer efficiency where a secondary transfer voltage that provide the maximum transfer efficiency is applied. In order to transfer the solid image without unevenness, transfer efficiency of at least 93% is required.

Figure 5:
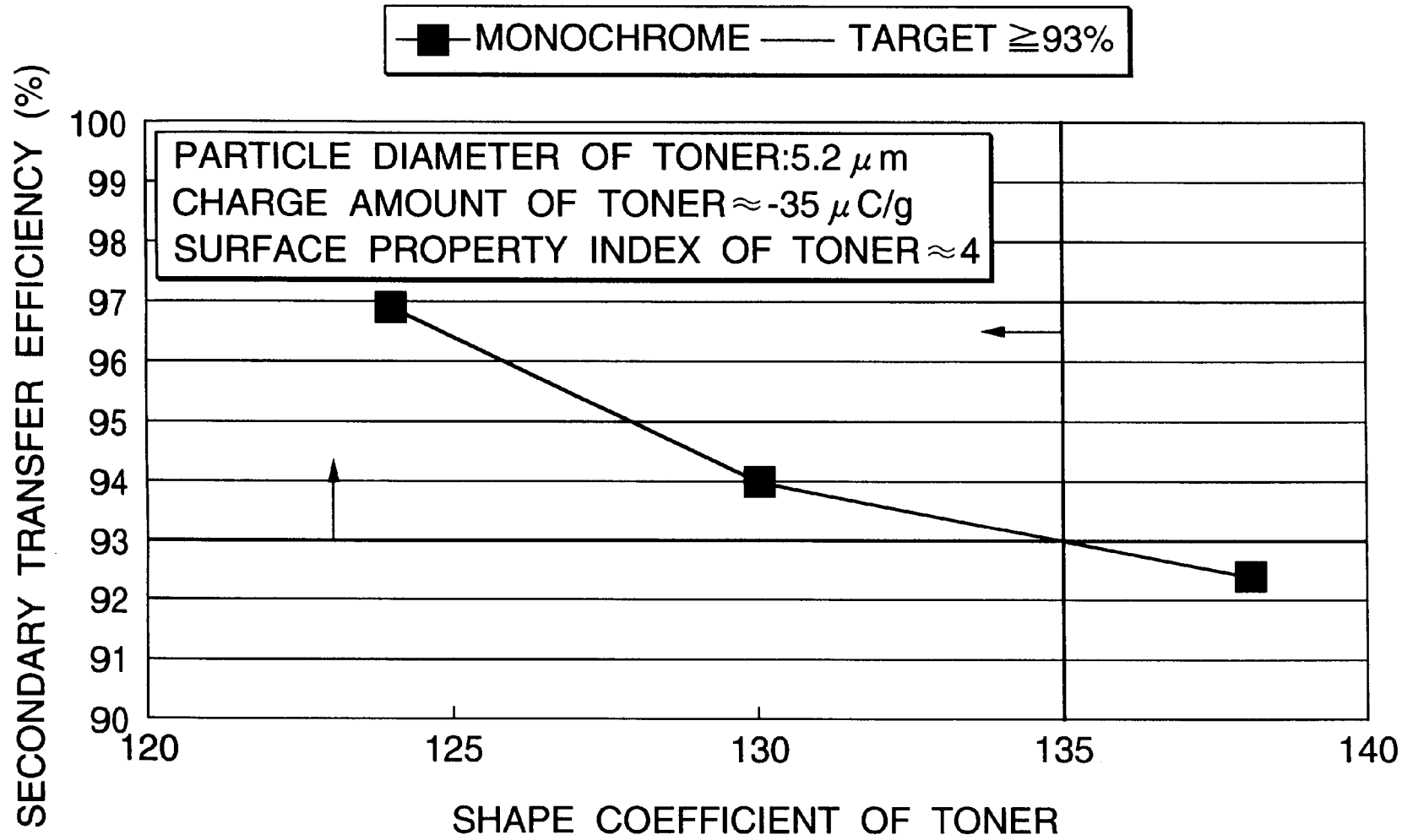
FIG. 5 is a graph showing the relationship between the shape coefficient and the transfer efficiency of the toner particles.

FIG. 5 shows the results of measurement of transfer efficiency. As understood from FIG. 5, the toners using the toner particles having shape coefficients of 120 and 130 exhibit high transfer efficiency, but transfer efficiency of 93% or more cannot be obtained by the toner using the toner particles having a shape coefficient of 138.

The image quality is evaluated by the extent of formation of image defects, such as transfer unevenness and drop off.

Four kinds of paper having different surface smoothness values 25, 32, 91 and 666 obtained by the Oken type measurement method are prepared, and a solid image of 100 $cm^2$ is formed on each kinds of paper. The extent of formation of transfer unevenness is confirmed with naked eye and evaluated for 9 grades. The surface smoothness of 91 corresponds to the level of ordinary paper, and the surface smoothness of 25 corresponds to the level of recycled paper.

The transfer unevenness grades of from 0 to 2 indicate unevenness that cannot be aware unless carefully checked, the transfer unevenness grades of from 2.5 to 3 indicate somewhat notable unevenness formed, and the transfer unevenness grades of from 3.5 to 4 indicate fatal unevenness formed.

Figure 6:
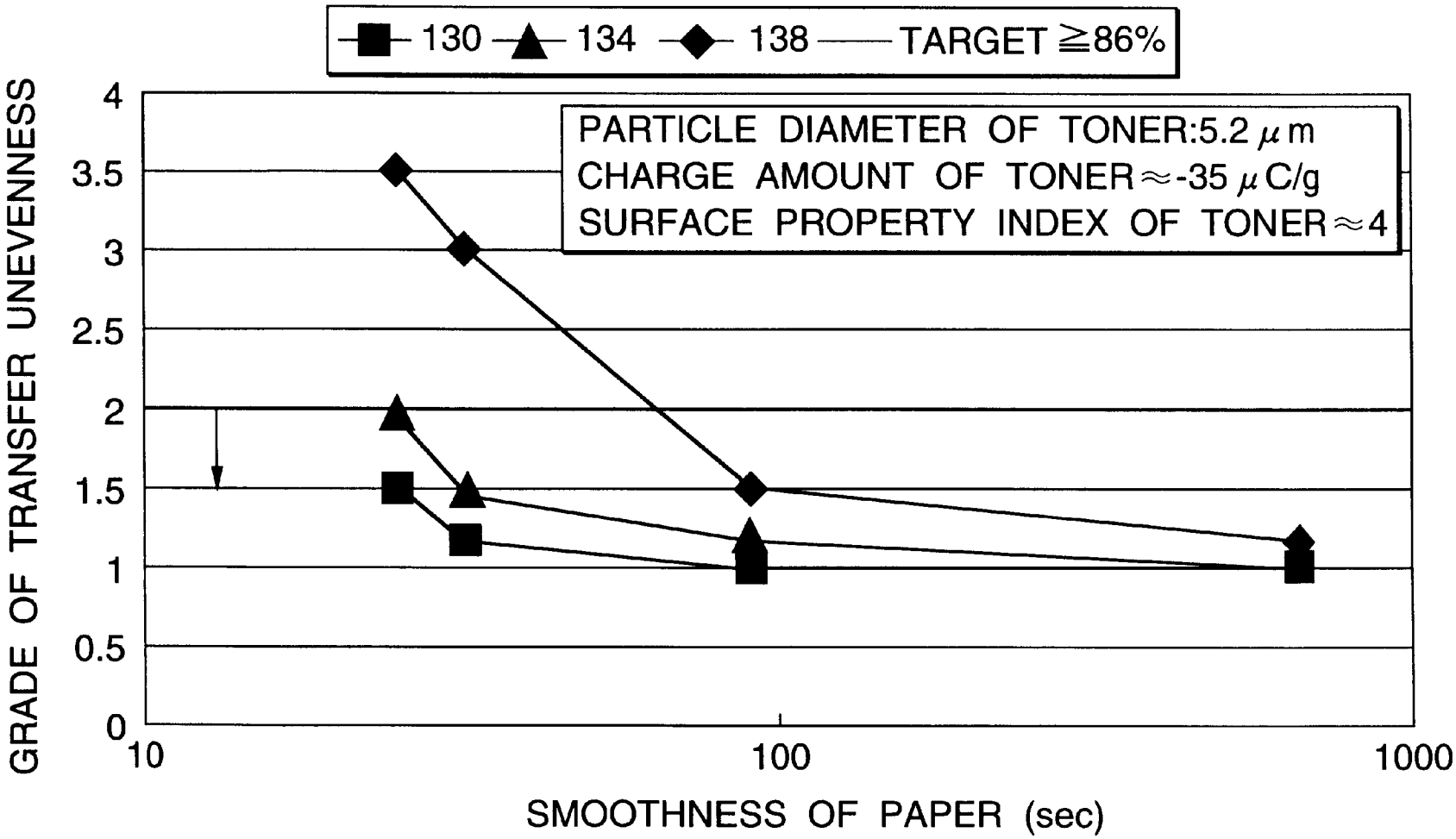
FIG. 6 is a graph showing the relationship between the shape coefficient of toner particles and the extent of occurrence of transfer unevenness when the smoothness of paper is changed.

The results of evaluation of transfer unevenness are shown in FIG. 6. As understood from FIG. 6, the toners using the toner particles having shape coefficients of 130 and 134 maintains the transfer unevenness grade of 2 or less even when the surface smoothness of the paper is decreased, but the toner using the toner particles having a shape coefficient of 138 exhibits a transfer unevenness grades that is suddenly deteriorated when the surface smoothness of the paper is decreased.

Furthermore, lineal drawings are formed on ordinary paper, and the extent of formation of drop off, i.e., lack of image, is confirmed with naked eye, which is evaluated for 9 grades. The drop off grades of from 0 to 2 indicate lack of image that cannot be aware unless carefully checked, the drop off grades of from 2.5 to 3 indicate somewhat notable lack of image formed, and the drop off grades of from 3.5 to 4 indicate fatal lack of image formed.

Figure 7:
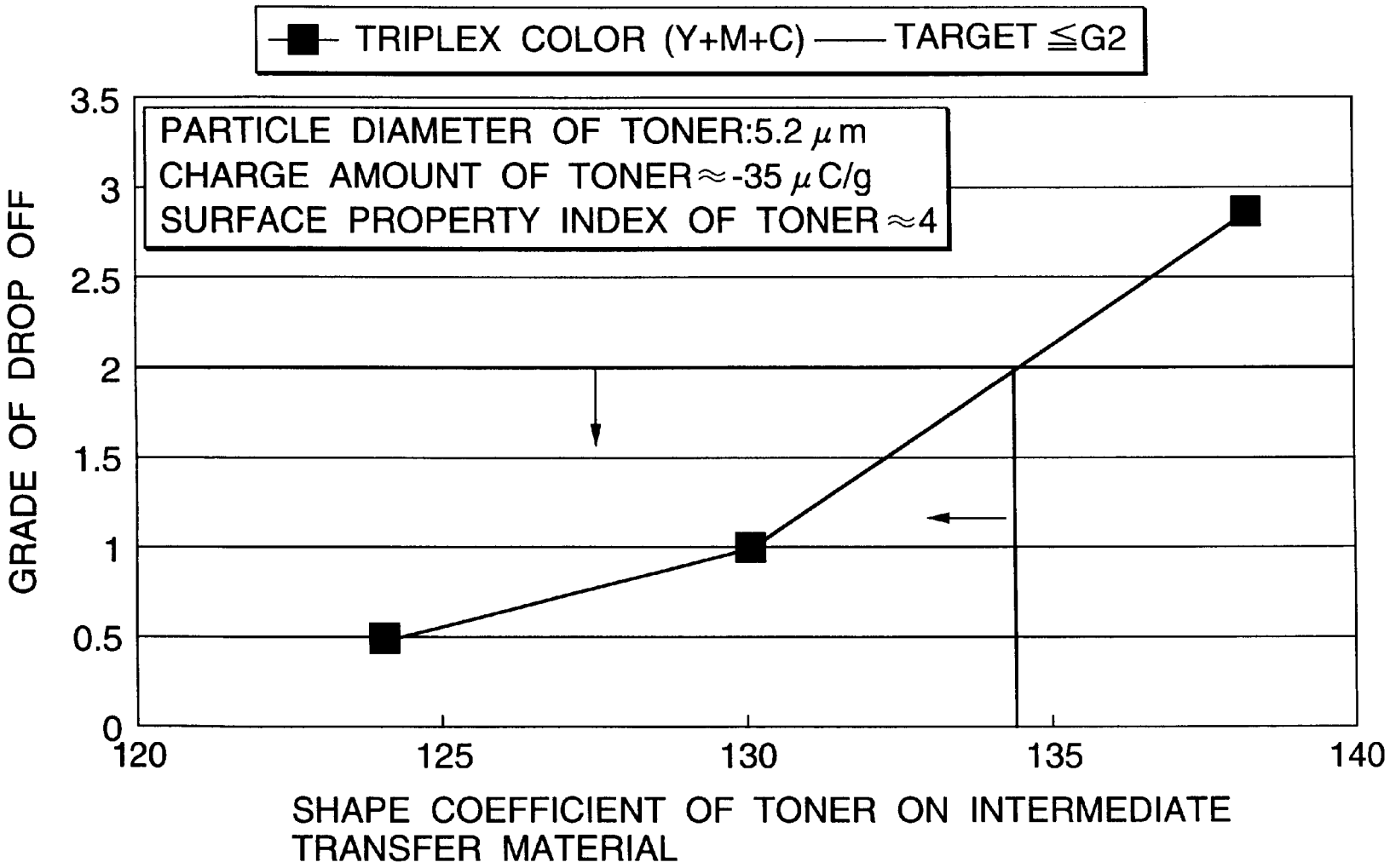
FIG. 7 is a graph showing the relationship between the shape coefficient of toner particles and the extent of occurrence of drop off.

FIG. 7 shows the evaluation results of the extent of formation of drop off. As understood from FIG. 7, the toners using the toner particles having shape coefficients of 124 and 130 provide a low drop off grade of 1 or less, but the toner using the toner particles having a shape coefficient of 138 suffers remarkable deterioration in drop off grade.

EXAMPLE 2

Three kinds of toners are obtained by using the toner particles obtained in Example 1 having a shape coefficient of 130, a surface property index of 4.0 and a volume average particle diameter of 5.2 μm, which is coated with an external additive (silica) having a maximum average particle diameter of 0.15 μm, while the coating ratio x of the external additive is changed to vary the shape coefficient after coating and the surface property index after coating as shown in Table 1 below.

TABLE 1

| | Toner 1 | Toner 2 | Toner 3 |
|---|---|---|---|
| Coating ratio of external additive (%) | 10 | 20 | 30 |
| Number of external additive | 10.89085 | 21.78171 | 32.67256 |
| Shape coefficient | 110.8666 | 109.8798 | 108.9104 |
| Surface property index | 1.009062 | 1.018125 | 1.027187 |

The external addition toners are mixed with a resin coated ferrite carrier having an average particle diameter of 35 μm to produce developers. The secondary transfer efficiency is evaluated in the same manner as in Example 1 by using the developers, and thus good results are obtained for all the toners.

EXAMPLE 3

Toner particles having different surface property indexes of 1.5, 4.0 and 9.0 in the same manner as in Example 1 except that the heating temperature and the heating time in the final step are changed. All the toners have a shape coefficient of 130 and a volume average particle diameter of 5.2 μm.

An external additive containing silica and titania is coated on the three kinds of toner particles. Among the external additive coated, the external additive (silica) having the maximum average particle diameter has a volume average particle diameter of 0.15 (μm), the coating ratio x of the external additive having the maximum average particle diameter to the surface area of the toner particles is 20%, and the surface property index after coating is 1.0181.

The external addition toners are mixed with a resin coated ferrite carrier having an average particle diameter of 35 μm to produce developers. The transfer performance is evaluated in the same manner as in Example 1 by using the developers. The results of the evaluation are shown below.

Figure 8:
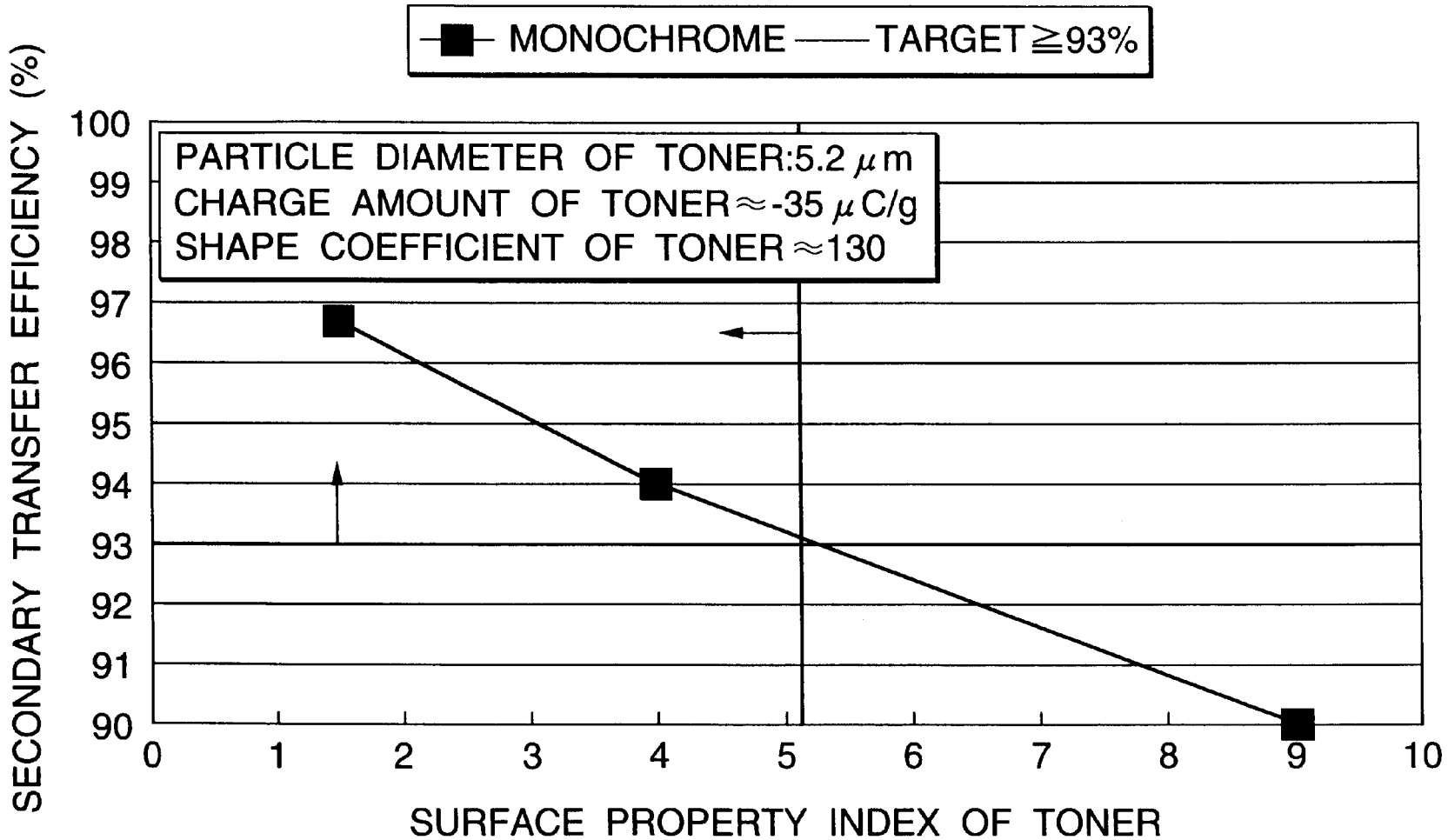
FIG. 8 is a graph showing the relationship between the surface property index of toner particles and the transfer efficiency.

FIG. 8 shows the measurement results of transfer efficiency. As understood from FIG. 8, the toners using the toner particles having surface property indexes of 1.5 and 4.0 exhibit high transfer efficiency, but the toner using the toner particles having a surface property index of 9.0 cannot provide transfer efficiency of 93% or more.

Figure 9:
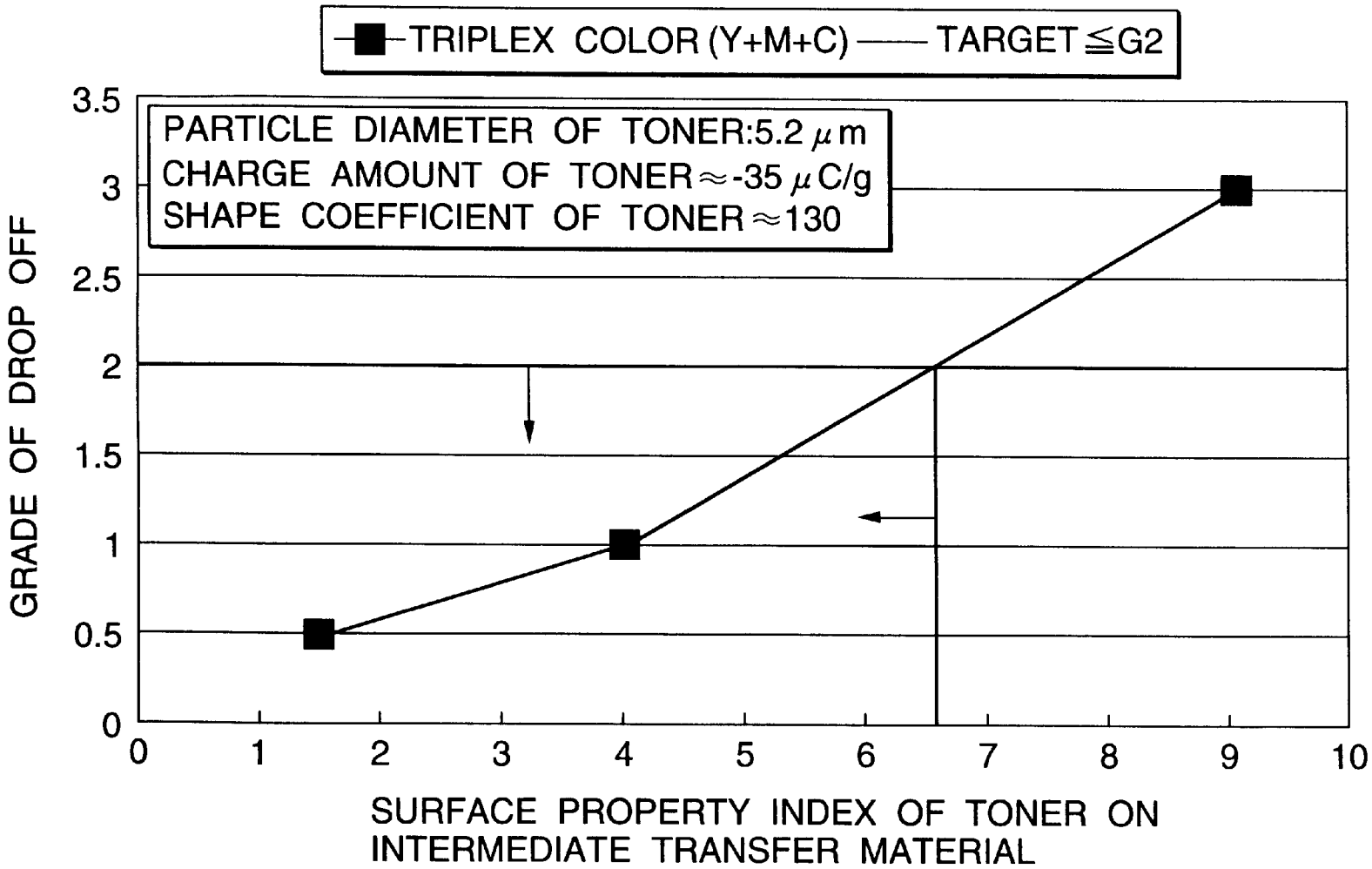
FIG. 9 is a graph showing the relationship between the surface property index of toner particles and the extent of occurrence of drop off.

FIG. 9 shows the evaluation results of extent of formation of drop off. As understood from FIG. 9, the toners using the toner particles having surface property indexes of 1.5 and 4.0 show a low drop off grade of 1 or less, but the toner using the toner particles having a surface property index of 9.0 suffers remarkable deterioration in drop off grade.

EXAMPLE 4

In addition to the black toner particles produced in Example 1 having a shape coefficient of 130, a surface property index of 4.0 and a volume average particle diameter of 5.2 μm, three kinds of toner particles having a shape coefficient of 130, a surface property index of 4.0 and a volume average particle diameter of 5.2 μm of three colors, yellow, magenta and cyan, are formed by replacing the coloring agent from the carbon black to C.I. Pigment Yellow 93, a 7/3 mixture of C.I. Pigment red 122 and C.I. Pigment Red 185, and C.I. Pigment Blue 15:3. Each kind of the color toner particles is coated with an external additive containing silica and titania to obtain toners of four colors. Among the external additive coated, the external additive (silica) having the maximum average particle diameter has a volume average particle diameter of 0.15 (μm), the coating ratio x of the external additive having the maximum average particle diameter to the surface area of the toner particles is 25%, and the shape coefficient after coating is 109.3929.

The color toners are mixed with various carriers shown below to produce color developers. The charge amounts of the toners are changed in the range of from −20 to −55 μC/g depending on the kinds of the carriers.

The transfer performance of the secondary transfer from the intermediate transfer belt is evaluated by using the color developers on a modified "A-Color" produced by Fuji Xerox Co., Ltd. having the constitution similar to the apparatus for forming an image shown in FIG. 2. The measurement results are shown in FIG. 10.

Figure 10:
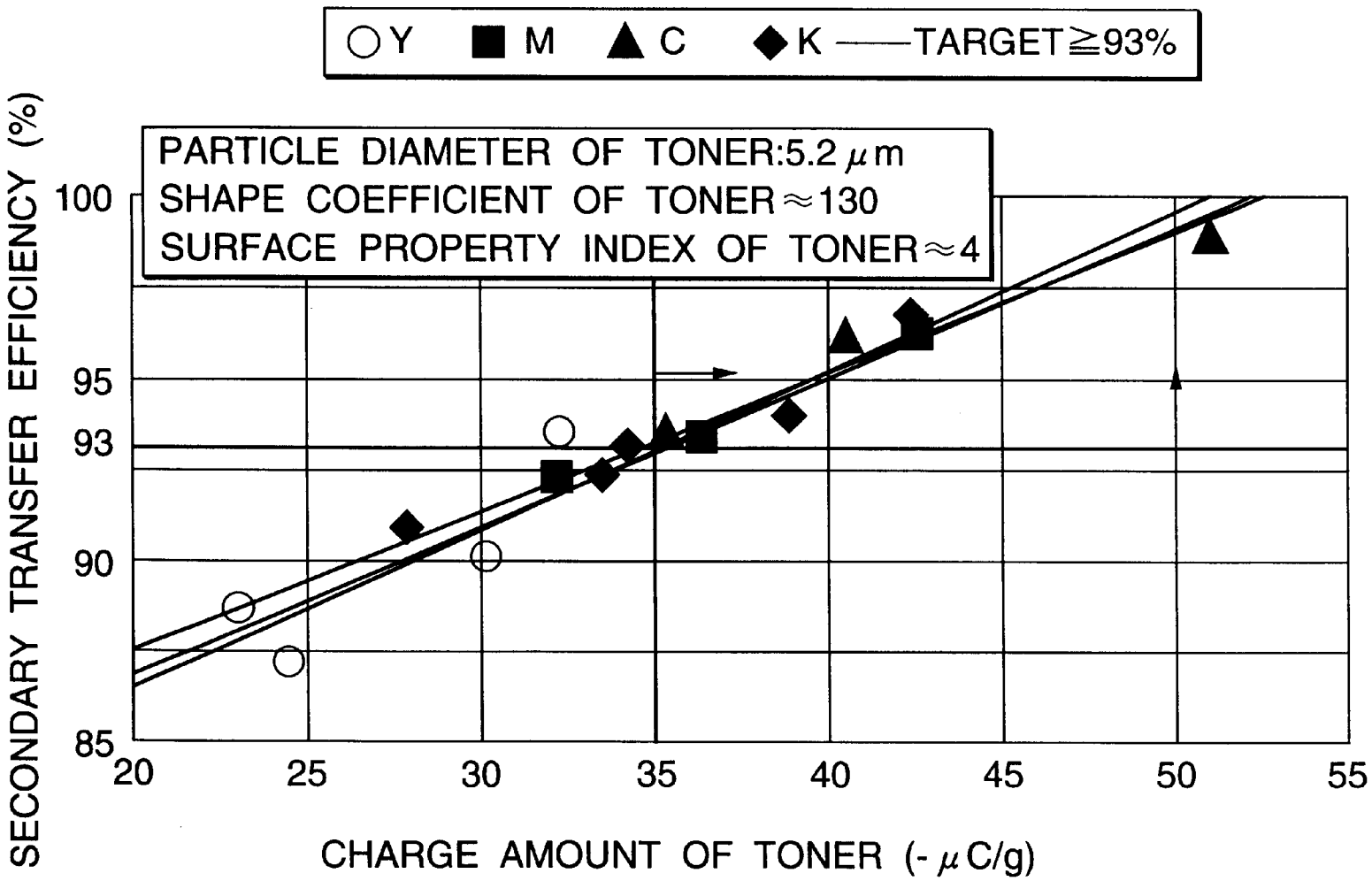
FIG. 10 is a graph showing the relationship between the charge amount of toner particles and the transfer efficiency.

As understood from FIG. 10, in the cases of all the color toners of any color, the toner exhibits high transfer efficiency when the charge amount of the toner is larger than −35 μC/g, but transfer efficiency of 93% or more cannot be obtained when the charge amount of the toner is less than −35 μC/g.

A solid image of 100 $cm^2$ is formed on ordinary paper by using the black toner with the charge amount varying to −18, −30 and −45 μC/g, the transfer unevenness is confirmed by naked eye and evaluated for 9 grades. The transfer unevenness grades of from 0 to 2 indicate unevenness that cannot be aware unless carefully checked, the transfer unevenness grades of from 2.5 to 3 indicate somewhat notable unevenness formed, and the transfer unevenness grades of from 3.5 to 4 indicate fatal unevenness formed.

Figure 11:
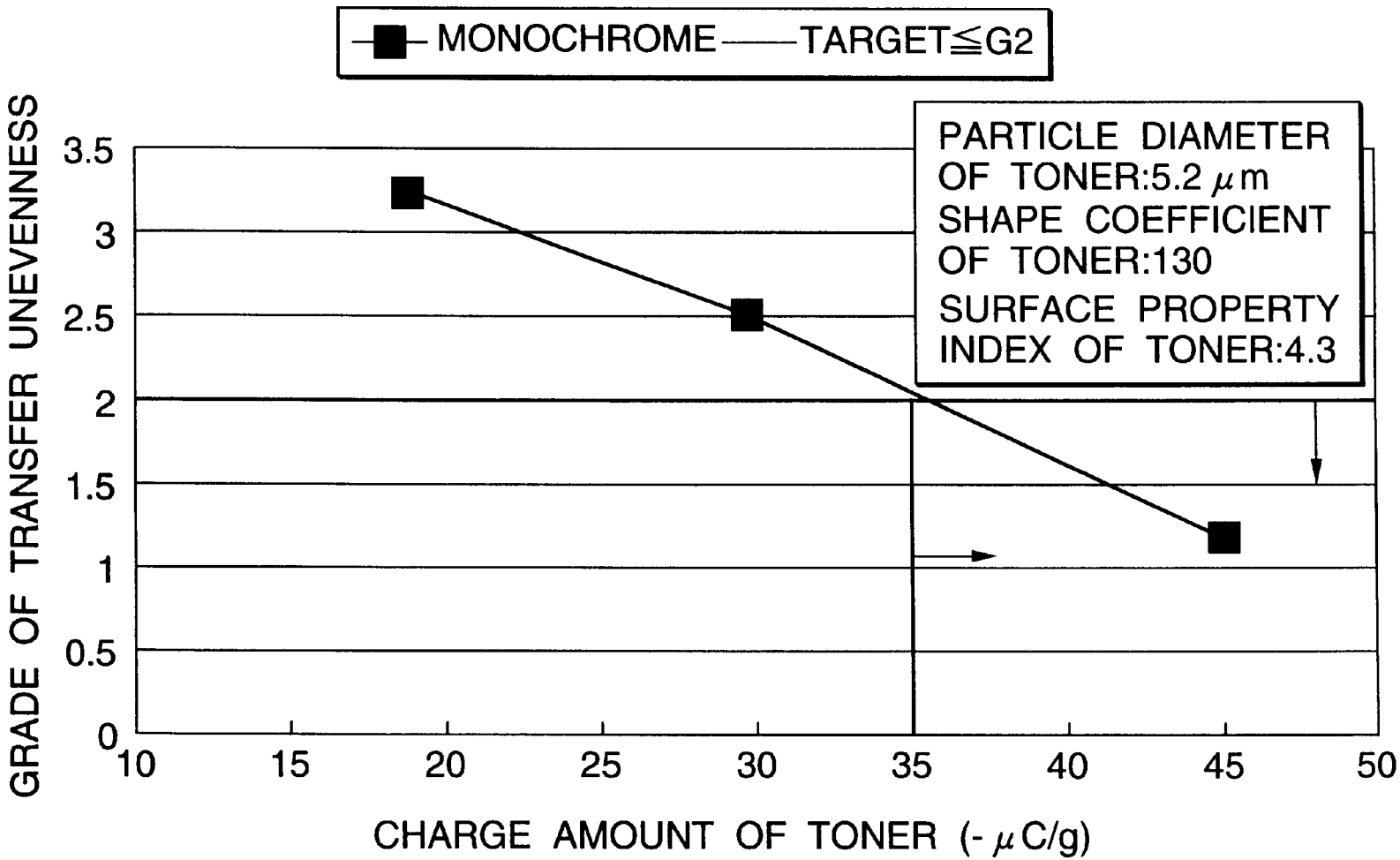
FIG. 11 is a graph showing the relationship between the charge amount of the toner particles and the extent of occurrence of transfer unevenness.

The evaluation results are shown in FIG. 11, in which the toner having a charge amount of −45 μC/g shows a transfer unevenness grade of about 1, but the toners having charge amounts of −18 and −30 μC/g suffer remarkable deterioration in transfer unevenness grade.

Figure 12:
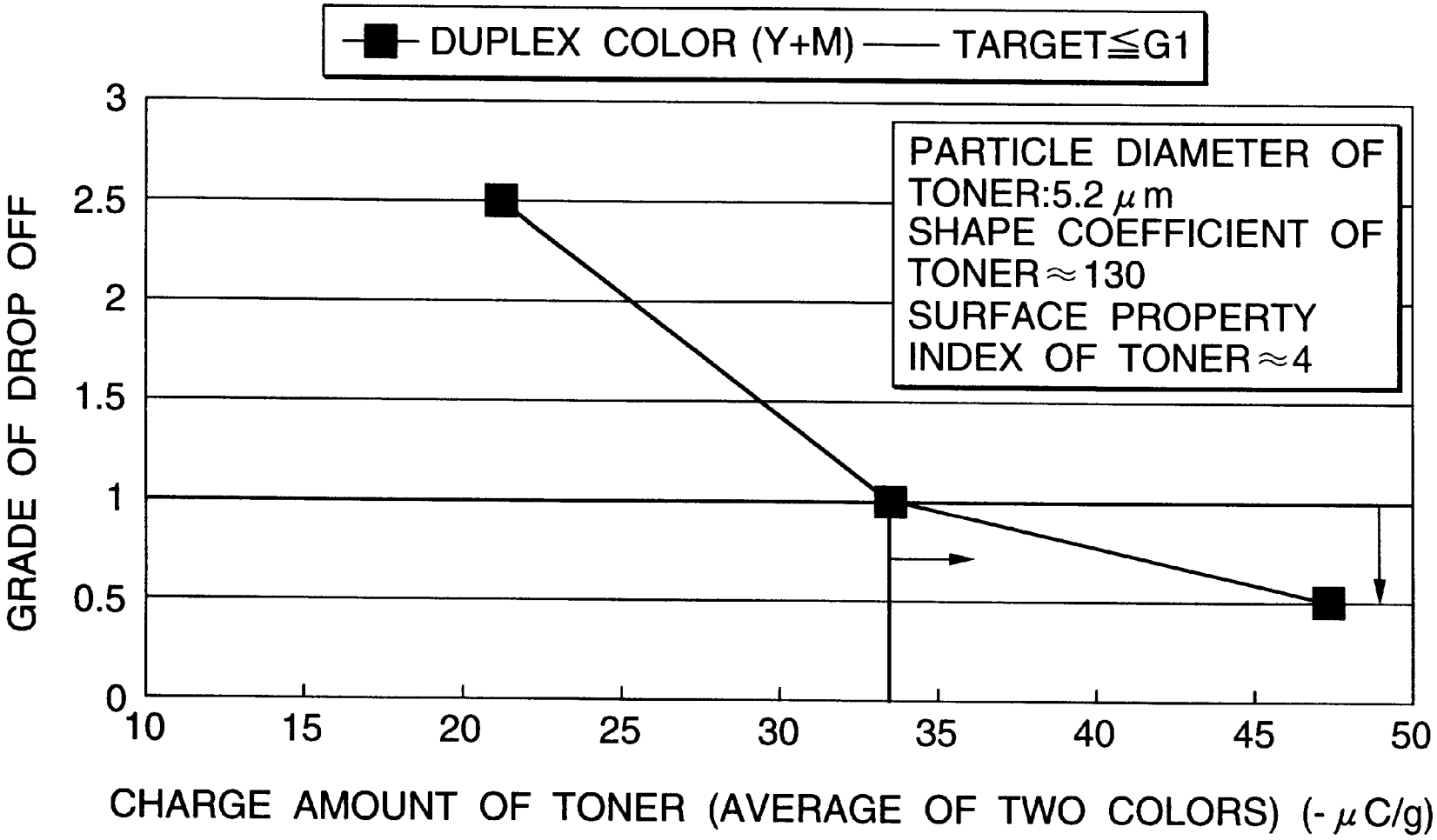
FIG. 12 is a graph showing the relationship between the charge amount of the toner particles and the extent of occurrence of drop off.

The extent of formation of drop off is evaluated in the same manner as in Example 1 by using the black toner with the charge amount varying to −21, −33 and −47 μC/g. The evaluation results are shown in FIG. 12, in which the toners having charge amounts of −33 and −47 μC/g show a drop off grade of 1 or less, but the toner having a charge amount of −21 μC/g suffers remarkable deterioration in drop off grade.

As described in the foregoing, the external addition toner of the invention exhibits an effect in that the effect of the external additive is sufficiently performed, and the transfer property is excellent. Furthermore, the apparatus for forming an image and the process for forming an image of the invention exhibit an effect in that an image of good quality can be obtained without forming image defects, such as transfer unevenness due to transfer failure of the toner or drop off, irrespective to the kind of the recording medium, and thus excellent general purpose property is obtained.

What is claimed is:

1. An external addition toner comprising toner particles and an external additive, the toner particles having a shape coefficient (SF1) of 134 or less, the external additive containing fine particles having a volume average particle diameter (d) of from 0.05 to 0.5 μm, a coating ratio (x) of the external additive to a surface area of the toner particles being in a range of from 15 to 100%, and the coating ratio x (%), a volume average particle diameter of the toner particles D (μm) and a volume average particle diameter of the external additive d (μm) satisfying the following equation (1):

$$100 \le \frac{(D+2d)^2}{\pi\left(\frac{D}{2}\right)^2 + n\pi\left(\frac{d}{2}\right)^2} \cdot \frac{\pi}{4} \cdot 100 \le 165 \quad (1)$$

wherein $$n = \frac{\pi D \frac{x}{100}}{d}.$$

2. An external addition toner as claimed in claim 1, wherein the toner particles has a surface property index of 5.1 or less.

3. An external addition toner as claimed in claim 1, wherein the external addition toner satisfies the following equation (2):

$$1.005 \le \frac{4\pi\left(\frac{D}{2}\right)^2 + n \cdot 4\pi\left(\frac{d}{2}\right)^2}{4 \cdot \pi\left(\frac{D}{2}\right)^2} \le 1.524 \quad (2)$$

wherein $$n = \frac{\pi \cdot D \cdot \frac{x}{100}}{d}.$$

4. An external addition toner as claimed in claim 1, wherein an absolute value of a charge amount q (μC/g) of the external addition toner satisfies the following equation (3):

$$q \geqq 929.5/D^2 \quad (3).$$

5. An external addition toner as claimed in claim 1, wherein the fine particles are an inorganic oxide.

6. An external addition toner as claimed in claim 5, wherein the fine particles are selected from silica and titania.

7. An external addition toner as claimed in claim 1, wherein the fine particles having a volume average particle diameter (d) of from 0.1 to 0.5 μm.

8. An external addition toner comprising toner particles and an external additive, the toner particles having a surface property index of 5.1 or less, the external additive containing fine particles having a volume average particle diameter (d) of from 0.05 to 0.5 μm, a coating ratio (x) of the external additive to a surface area of the toner particles being in a range of from 15 to 100%, and the coating ratio x (%), a volume average particle diameter of the toner particles D ($\mu$m) and a volume average particle diameter of the external additive d ($\mu$m) satisfying the following equation (2):

$$1.005 \leq \frac{4\pi\left(\frac{D}{2}\right)^2 + n \cdot 4\pi\left(\frac{d}{2}\right)^2}{4 \cdot \pi\left(\frac{D}{2}\right)^2} \leq 1.524 \quad (2)$$

wherein $$n = \frac{\pi \cdot D \cdot \frac{x}{100}}{d}.$$

9. An external addition toner as claimed in claim 8, wherein an absolute value of a charge amount q ($\mu$C/g) of the external addition toner satisfies the following equation (3):

$$q \geqq 929.5/D^2 \quad (3).$$

10. An external addition toner as claimed in claim 8, wherein the fine particles are an inorganic oxide.

11. An external addition toner as claimed in claim 8, wherein the fine particles are selected from silica and titania.

12. An external addition toner as claimed in claim 8, wherein the fine particles having a volume average particle diameter (d) of from 0.1 to 0.5 $\mu$m.

13. An apparatus for forming an image comprising a unit for forming a latent image on a latent image holding member, a unit for developing the latent image with a developer containing a toner, and a unit for transferring a toner image formed on the latent image holding member to a transfer medium, the toner is an external addition toner as claimed in claim 1.

14. An apparatus for forming an image as claimed in claim 13, wherein the developer is a two-component developer comprising a toner and a carrier.

15. An apparatus for forming an image as claimed in claim 13, wherein the apparatus further comprises an intermediate transfer material, on which the toner image formed on the latent image holding member is transferred and temporarily retained, and a unit for transferring the toner image on the intermediate transfer material to the transfer medium with a transfer member.

16. An apparatus for forming an image as claimed in claim 13, wherein the intermediate transfer material has a surface having a contact angle with water of 750 or more.

17. An apparatus for forming an image as claimed in claim 13, wherein a multi-color image formed on the intermediate transfer material.

18. An apparatus for forming an image as claimed in claim 13, wherein a pressure between the intermediate transfer material and the transfer member is 10 gf/mm or more.

19. An apparatus for forming an image as claimed in claim 13, wherein the external addition toner satisfies the following equation (2):

$$1.005 \leq \frac{4\pi\left(\frac{D}{2}\right)^2 + n \cdot 4\pi\left(\frac{d}{2}\right)^2}{4 \cdot \pi\left(\frac{D}{2}\right)^2} \leq 1.524 \quad (2)$$

wherein $$n = \frac{\pi \cdot D \cdot \frac{x}{100}}{d}.$$

20. An apparatus for forming an image as claimed in claim 13, wherein an absolute value of a charge amount q ($\mu$C/g) of the external addition toner satisfies the following equation (3):

$$q \geqq 929.5/D^2 \quad (3).$$

* * * * *